US008138660B2

(12) United States Patent
Nakamura et al.

(10) Patent No.: US 8,138,660 B2
(45) Date of Patent: Mar. 20, 2012

(54) PLASMA JET SPARK PLUG

(75) Inventors: Toru Nakamura, Aichi (JP); Tomoaki Kato, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 12/904,193

(22) Filed: Oct. 14, 2010

(65) Prior Publication Data

US 2011/0037373 A1 Feb. 17, 2011

Related U.S. Application Data

(62) Division of application No. 12/057,520, filed on Mar. 28, 2008, now Pat. No. 7,839,065.

(30) Foreign Application Priority Data

Mar. 30, 2007 (JP) ..... 2007-092509
Feb. 12, 2008 (JP) ..... 2008-030584

(51) Int. Cl.
*H01T 13/20* (2006.01)

(52) U.S. Cl. ..... 313/143; 313/139; 313/141

(58) Field of Classification Search ..... 313/118–145; 123/169 R, 169 EL, 32, 41, 310
See application file for complete search history.

(56) References Cited

FOREIGN PATENT DOCUMENTS

| | | |
|---|---|---|
| JP | 56167288 | 12/1981 |
| JP | 1274374 | 11/1989 |
| JP | 2072577 | 3/1990 |

OTHER PUBLICATIONS

Office Action from corresponding Japanese Patent Application No. 2009-161486, issued on Sep. 13, 2011; 6 pages.

*Primary Examiner* — Nimeshkumar Patel
*Assistant Examiner* — Donald Raleigh
(74) *Attorney, Agent, or Firm* — Kusner & Jaffe

(57) ABSTRACT

A plasma jet spark plug comprising:
a center electrode;
an insulator having an axial bore extending in an axial direction, and retaining the center electrode within the axial bore;
a metallic shell surrounding and retaining the insulator from outside with respect to a radial direction perpendicular to the axial direction; and
a ground electrode disposed frontward of the front end portion of the insulator with respect to the axial direction, wherein the ground electrode has a contact portion contacting the front end portion of the insulator in an annular contact zone, the ground electrode is not in contact with the metallic shell with respect to the axial direction and the ground electrode is in contact with the metallic shell with respect to a radial direction perpendicular to the axial direction and is electrically connected with the metallic shell by means of an outer peripheral portion thereof being joined to the metallic shell.

6 Claims, 25 Drawing Sheets

PLASMA JET SPARK PLUG

This application is a divisional of Application Ser. No. 12/057,520 filed on Mar. 28, 2008 now U.S. Pat. No. 7,839,065.

FIELD OF THE INVENTION

The present invention relates to a plasma jet spark plug for generating plasma and igniting an air-fuel mixture in an internal combustion engine.

BACKGROUND OF THE INVENTION

Conventionally, a spark plug for an internal combustion engine, for example, automotive ignites an air-fuel mixture through spark discharge. In recent years, high output and low fuel consumption have been demanded from internal combustion engines. To fulfill such requirements, plasma jet spark plugs are used. A plasma jet spark plug provides quick propagation of combustion and exhibits such a high ignition performance as to be capable of reliably igniting even a lean air-fuel mixture having a higher ignition-limit air-fuel ratio.

Such a plasma jet spark plug has a structure in which an insulator formed from ceramics or the like surrounds a spark discharge gap between a center electrode and a ground electrode integrated with a metallic shell, thereby forming a small-volume discharge space called a cavity. A high voltage is applied to the spark discharge gap so as to perform spark discharge. By virtue of associated occurrence of dielectric breakdown, current can be applied at a relatively low voltage. Thus, through transition of a discharge state effected by further supply of energy, plasma is generated within the cavity. Since the ground electrode is located frontward of the insulator having the cavity formed therein, the ground electrode has a hole called an orifice formed therein. Plasma is emitted outward through the orifice, thereby igniting an air fuel mixture.

Meanwhile, if a clearance is present between the ground electrode and the insulator and if, during emission of plasma through the orifice, energy of the plasma leaks into the clearance and into a clearance between the metallic shell and the insulator communicating with the former clearance, energy of plasma emitted through the orifice reduces, thereby causing impairment in ignition performance. To cope with the problem, there has been proposed a plasma jet spark plug in which an insulator (housing) is provided in close contact with a ground electrode (external electrode) so that no clearance is present between the insulator and the ground electrode. For example, Japanese Patent Application Laid-Open (kokai) No. 2006-294257 discloses a plasma jet spark plug wherein, the ground electrode and a metallic shell are integrally formed, so that the ground electrode (a portion of the metallic shell which corresponds to the ground electrode) is accurately positioned in relation to the metallic shell. Accordingly, dimensional adaptation of the insulator will be sufficient for establishment of close contact between the insulator and the ground electrode. When the insulator is retained by the metallic shell, a front end portion of the insulator abuts the ground electrode.

In the process for manufacturing the plasma jet spark plug, since the insulator is retained by the metallic shell through crimping, a displacement of the insulator may arise. However, precise control of the displacement is difficult. In some displaced condition, a crimping load may be applied to the insulator in such a manner that a front end portion of the insulator strongly butts against the ground electrode, potentially causing breakage of the insulator.

SUMMARY OF THE INVENTION

An advantage of the invention is a plasma jet spark plug configured in such a manner as to reduce leakage of energy of plasma into a clearance between an insulator and a ground electrode disposed frontward of the insulator and into a clearance between a metallic shell and the insulator communicating with the former clearance and to avoid strong butting of the insulator against the ground electrode.

According to a first aspect of the present invention, there is provided a plasma jet spark plug comprising: a center electrode; an insulator having an axial bore extending in an axial direction, and retaining the center electrode within the axial bore in such a manner as to accommodate a front end face of the center electrode within a front end portion of the axial bore; a cavity formed in a front end portion of the insulator, the cavity being essentially a recess defined by a wall surface of the axial bore and a front end face of the center electrode; a metallic shell surrounding and retaining the insulator from outside with respect to a radial direction perpendicular to the axial direction; and a ground electrode disposed frontward of the front end portion of the insulator with respect to the axial direction and having a contact portion contacting the front end portion of the insulator in an annular contact zone such that, as viewed from the axial direction, an opening of the cavity is located internally of the contact portion, and a communication section for establishing communication between the cavity and an ambient atmosphere. In the plasma jet spark plug, the ground electrode is not in contact with the metallic shell with respect to the axial direction and is in contact with the metallic shell with respect to a radial direction perpendicular to the axial direction and is electrically connected with the metallic shell by means of an outer peripheral portion thereof being joined to the metallic shell.

According to the first aspect of the present invention, the ground electrode is joined to the metallic shell in a state in which the contact portion of the ground electrode is in contact with the front end portion of the insulator, thereby closing a clearance which may be formed between the ground electrode and the front end portion of the insulator, and a clearance which may be formed between the insulator and the metallic shell. Accordingly, if such clearances are not closed, at the time of emission of plasma generated within the cavity, energy of plasma may leak into the clearances; however, according to the present invention, such leakage of energy is prevented, thereby preventing impairment in ignition performance. Also, the ground electrode is joined to the metallic shell in a state in which the contact portion of the ground electrode is in contact with the front end portion of the insulator and in which the ground electrode and the metallic shell are not in contact with each other with respect to the axial direction. An associated clearance which is provided along the axial direction between the ground electrode and the metallic shell absorbs an assembly error along the axial direction which may arise in the process of retaining the insulator in the metallic shell. Thus, when the outer peripheral portion of the ground electrode is joined to the metallic shell in the process of manufacture, the above-described configuration avoid strong butting of the contact portion of the ground electrode against the front end portion of the insulator. Therefore, the insulator is free from breakage which could otherwise result from an increase in stress caused by strong butting of the contact portion against the front end portion of the insulator.

In the plasma jet spark plug according to the present invention, the ground electrode is in contact with the front end portion of the insulator. Herein, the term "contact" means not only a state in which they touch each other, but also a state in which they abut against each other with a relatively weak pressing force. The expression "a state in which they abut against each other with a relatively weak pressing force" means that the ground electrode and the front end portion of the insulator abut against each other in such a manner that an associated pressing force therebetween is of a magnitude that causes no damage to the insulator. That is, the front end portion of the insulator does not strongly butt against the ground electrode, so that stress generated in the insulator does not increase. Specifically, the ground electrode and the front end portion of the insulator abut against each other with a pressing force whose magnitude suffices for preventing leakage of plasma emitted from the cavity and is not necessarily intended to prevent leakage of combustion pressure received from a combustion chamber.

According to a second aspect of the present invention, there is provided a plasma jet spark plug comprising a center electrode; an insulator having an axial bore extending in an axial direction, and retaining the center electrode within the axial bore in such a manner as to accommodate a front end face of the center electrode within a front end portion of the axial bore; a cavity formed in a front end portion of the insulator, in a form of a recess defined by a wall surface of the axial bore and a front end face of the center electrode; a metallic shell surrounding and retaining the insulator from outside with respect to a radial direction perpendicular to the axial direction; and a ground electrode disposed frontward of the front end portion of the insulator with respect to the axial direction and having a contact portion contacting the front end portion of the insulator in an annular contact zone such that, as viewed from the axial direction, an opening of the cavity is located internally of the contact portion, and a communication section for establishing communication between the cavity and an ambient atmosphere. In the plasma jet spark plug, the ground electrode is a composite member formed by joining an electrode base metal and a contact member together. The electrode base metal is not in contact with the insulator with respect to the axial direction, is in contact with the metallic shell, and is electrically connected with the metallic shell by means of an outer peripheral portion thereof being joined to the metallic shell. The contact member has the contact portion. A portion of the electrode base metal and the contact member form the communication section.

According to the second aspect of the present invention, the ground electrode is joined to the metallic shell in a state in which the contact portion of the ground electrode is in contact with the front end portion of the insulator, thereby closing a clearance which may be formed between the ground electrode and the front end portion of the insulator, and a clearance which may be formed between the insulator and the metallic shell. Accordingly, if such clearances are not closed, at the time of emission of plasma generated within the cavity, energy of plasma may leak into the clearances; however, according to the present invention, such leakage of energy is prevented, thereby preventing impairment in ignition performance. Also, the ground electrode is a composite member formed by joining the electrode base metal and the contact member together. By virtue of this, in the process of manufacture, a step for joining the outer peripheral portion of the electrode base metal to the metallic shell and a step for joining the contact member to the electrode base metal in a state in which the contact member is in contact with the front end portion of the insulator can be separated from each other. A clearance along the axial direction between the electrode base metal and the front end portion of the insulator absorbs an assembly error along the axial direction which may arise in the process of retaining the insulator in the metallic shell. Thus, in the process of joining the outer peripheral portion of the ground electrode to the metallic shell, the above-described configuration avoid strong butting of the contact portion of the ground electrode against the front end portion of the insulator. Therefore, the insulator is free from breakage which could otherwise result from an increase in stress caused by strong butting of the contact portion against the front end portion of the insulator.

According to a third aspect of the present invention, in addition to the constitution of the second aspect of the present invention, the electrode base metal of the ground electrode has an inwardly projecting portion located most inward with respect to the radial direction; the contact member of the ground electrode has an outwardly projecting portion whose outer periphery is located radially outward of an inner periphery of the inwardly projecting portion; and the outwardly projecting portion is disposed rearward of the inwardly projecting portion with respect to the axial direction.

According to the third aspect of the present invention, the outwardly projecting portion of the contact member is disposed rearward, with respect to the axial direction, of the inwardly projecting portion of the electrode base metal used to form the ground electrode. Thus, the outwardly projecting portion of the contact member is held between the front end portion of the insulator and the inwardly projecting portion of the electrode base metal. Accordingly, even when deterioration arises with respect to a joined condition between the contact member and the electrode base metal as a result of use of the plasma jet spark plug over a long term, the electrode base metal can prevent falling-off (dropping-off) of the contact member.

According to a fourth aspect of the present invention, in addition to the constitution of the second or third aspect of the present invention, the electrode base metal of the ground electrode has an inwardly projecting portion located most inward with respect to the radial direction; the contact member of the ground electrode has an outwardly projecting portion whose outer periphery is located radially outward of an inner periphery of the inwardly projecting portion; and the outer peripheral portion of the ground electrode is joined to the metallic shell such that the outwardly projecting portion is disposed frontward of the inwardly projecting portion with respect to the axial direction.

According to the fourth aspect of the present invention, the outwardly projecting portion of the contact member is disposed frontward of the inwardly projecting portion of the electrode base metal with respect to the axial direction, and the contact member and the electrode base metal are joined together while the contact member is positioned by use of the outwardly projecting portion. This can prevent off-axis disposition of the contact member.

According to a fifth aspect of the present invention, in addition to the constitution of any one of the first to fourth aspects of the present invention, at least a portion of an inner peripheral wall of the communication section of the ground electrode is formed of a noble-metal member made of a noble metal.

In order to generate plasma within the cavity, high energy is applied between the ground electrode and the center electrode. Therefore, plasma has high energy, resulting in consumption of the ground electrode. According to the fifth aspect of the present invention, at least a portion of the inner peripheral wall of the communication section of the ground electrode is formed of a noble-metal member, thereby lowering consumption of the ground electrode caused by high energy of plasma.

According to a sixth aspect of the present invention, in addition to the constitution of any one of the first to fifth aspects of the present invention, the front end portion of the insulator has an engagement portion with which the contact portion is engaged.

According to the sixth aspect of the present invention, the contact portion of the ground electrode is engaged with the engagement portion of the front end portion of the insulator, whereby off-axis disposition of the contact member can be prevented. Also, the contact portion and the engagement portion are in close contact with each other at an interface therebetween, thereby closing a clearance which may be formed between the ground electrode and the front end portion of the insulator and a clearance which may be formed between the insulator and the metallic shell, the clearances being located radially outward of the interface.

According to a seventh aspect of the present invention, there is provided a manufacturing method for a plasma jet spark plug which comprises a center electrode; an insulator having an axial bore extending in an axial direction, and retaining the center electrode within the axial bore in such a manner as to accommodate a front end face of the center electrode within a front end portion of the axial bore; a cavity formed in a front end portion of the insulator, in a form of a recess defined by a wall surface of the axial bore and a front end face of the center electrode; a metallic shell surrounding and retaining the insulator from outside with respect to a radial direction perpendicular to the axial direction; and a ground electrode disposed frontward of the front end portion of the insulator with respect to the axial direction and having a contact portion contacting the front end portion of the insulator in an annular contact zone such that, as viewed from the axial direction, an opening of the cavity is located internally of the contact portion, and a communication section for establishing communication between the cavity and an ambient atmosphere. The manufacturing method comprises an insulator-retaining step for retaining in the metallic shell the insulator, which, in turn, retains the center electrode therein; a disposing step for, after the insulator-retaining step, disposing the ground electrode frontward of the front end portion of the insulator with respect to the axial direction, not in contact with the metallic shell with respect to the axial direction, and such that the contact portion of the ground electrode is in contact with the front end portion of the insulator; and a ground-electrode-joining step for joining an outer peripheral portion of the ground electrode to the metallic shell in a state in which the contact portion remains in contact with the insulator.

In the manufacturing method for a plasma jet spark plug according to the seventh aspect of the present invention, before the ground electrode is joined to the metallic shell, the insulator is retained in the metallic shell. Therefore, in the retaining process, an object which presses the front end portion of the insulator is absent, whereby breakage of the insulator can be prevented. The insulator is retained in the metallic shell by, usually, crimping. An associated assembly error can be absorbed by adjusting the position of the ground electrode in relation to the front end portion of the insulator, when the ground electrode is joined to the metallic shell.

Also, when the ground electrode is disposed, the contact portion of the ground electrode is brought in contact with the front end portion of the insulator. While this condition is maintained, the ground electrode is joined to the metallic shell, thereby closing a clearance which may be formed between the ground electrode and the front end portion of the insulator and a clearance which may be formed between the insulator and the metallic shell and communicates with the former clearance. In use of the thus-manufactured plasma jet spark plug, when plasma generated within the cavity is emitted, leakage of energy into such clearances can be lowered, thereby preventing impairment in ignition performance.

According to an eighth aspect of the present invention, in addition to the constitution of the seventh aspect of the present invention, the ground electrode is a composite member formed by joining a noble-metal member to an electrode base metal, a portion of the electrode base metal and the noble-metal member constituting the communication section; the manufacturing method further comprises a noble-metal-member-joining step for joining the noble-metal member to the electrode base metal, the noble-metal-member-joining step preceding the disposing step; and in the ground-electrode-joining step, an outer peripheral portion of the electrode base metal is joined to the metallic shell in a state in which the contact portion provided on at least one of the electrode base metal and the noble-metal member of the ground electrode remains in contact with the front end portion of the insulator.

In use of the thus-manufactured plasma jet spark plug, in order to generate plasma within the cavity, high energy is applied between the ground electrode and the center electrode. Therefore, plasma has high energy, resulting in consumption of the ground electrode. According to the eighth aspect of the present invention, the plasma jet spark plug is manufactured by use of the ground electrode which is formed, before the disposing step, by joining the noble metal member to the electrode base metal, thereby lowering consumption of the ground electrode caused by high energy of plasma.

According to a ninth aspect of the present invention, there is provided a manufacturing method for a plasma jet spark plug which comprises a center electrode; an insulator having an axial bore extending in an axial direction, and retaining the center electrode within the axial bore in such a manner as to accommodate a front end face of the center electrode within a front end portion of the axial bore; a cavity formed in a front end portion of the insulator, in a form of a recess defined by a wall surface of the axial bore and a front end face of the center electrode; a metallic shell surrounding and retaining the insulator from outside with respect to a radial direction perpendicular to the axial direction; and a ground electrode disposed frontward of the front end portion of the insulator with respect to the axial direction and having a contact portion contacting the front end portion of the insulator in an annular contact zone such that, as viewed from the axial direction, an opening of the cavity is located internally of the contact portion, and a communication section for establishing communication between the cavity and an ambient atmosphere. The ground electrode is a composite member formed by joining an electrode base metal and a contact member together. The electrode base metal has an inwardly projecting portion located most inward with respect to the radial direction, is not in contact with the insulator with respect to the axial direction, and is in contact with the metallic shell. The contact member has the contact portion and an outwardly projecting portion whose outer periphery is located radially outward of an inner periphery of the inwardly projecting portion. A portion of the electrode base metal and the contact member constitute the communication section. The manufacturing method comprises an insulator-retaining step for retaining in the metallic shell the insulator, which, in turn, retains the center electrode therein; a disposing step having a contact-member-disposing step for, after the insulator-retaining step, disposing the contact member at the front end portion of the insulator and an electrode-base-metal-disposing step for disposing the electrode base metal frontward of the front end portion of the insulator with respect to the axial direction while disposing the contact member in the communication section of the electrode base metal such that the inwardly projecting portion of the electrode base metal is disposed frontward of the outwardly projecting portion of the contact member with respect to the axial direction; a ground-electrode-joining step for joining an outer peripheral portion of the electrode base metal of the ground electrode to the metallic shell; and a contact-member-joining step for, after the ground-electrode-joining step, joining the contact member and the electrode base metal together in a state in which the contact member is in contact with the front end portion of the insulator.

According to the ninth aspect of the present invention, the ground electrode is a composite member formed by joining the electrode base metal and the contact member together; the contact member has the outwardly projecting portion; and the electrode base metal is joined to the metallic shell such that the outwardly projecting portion is held between the inwardly projecting portion of the electrode base metal and the front end portion of the insulator. By virtue of this, falling-off (dropping-off) of the contact member can be prevented. Furthermore, subsequent to the process of joining the electrode base metal to the metallic shell, the contact member is joined to the electrode base metal in a state in which the contact member is in contact with the front end portion of the insulator, thereby closing a clearance which may be formed between the ground electrode and the front end portion of the insulator and a clearance which may be formed between the insulator and the metallic shell and communicates with the former clearance. That is, the ground-electrode-joining step for joining the outer peripheral portion of the electrode base metal to the metallic shell and the contact-member-joining step for joining the contact member to the electrode base metal in a state in which the contact member is in contact with the front end portion of the insulator can be separated from each other. As in the case of the aforementioned aspects of the present invention, before the electrode base metal is joined to the metallic shell, the insulator is retained in the metallic shell; therefore, an assembly error along the axial direction which may arise in the process of retaining the insulator in the metallic shell is absorbed, thereby preventing breakage of the insulator.

According to a tenth aspect of the present invention, there is provided a manufacturing method for a plasma jet spark plug which comprises a center electrode; an insulator having an axial bore extending in an axial direction, and retaining the center electrode within the axial bore in such a manner as to accommodate a front end face of the center electrode within a front end portion of the axial bore; a cavity formed in a front end portion of the insulator, in a form of a recess defined by a wall surface of the axial bore and a front end face of the center electrode; a metallic shell surrounding and retaining the insulator from outside with respect to a radial direction perpendicular to the axial direction; and a ground electrode disposed frontward of the front end portion of the insulator with respect to the axial direction and having a contact portion contacting the front end portion of the insulator in an annular contact zone such that, as viewed from the axial direction, an opening of the cavity is located internally of the contact portion, and a communication section for establishing communication between the cavity and an ambient atmosphere. The ground electrode is a composite member formed by joining an electrode base metal and a noble-metal member together. The electrode base metal has an inwardly projecting portion located most inward with respect to the radial direction. The noble-metal member has an outwardly projecting portion whose outer periphery is located radially outward of an inner periphery of the inwardly projecting portion. A portion of the electrode base metal and the noble-metal member constitute the communication section. The manufacturing method comprises an insulator-retaining step for retaining in the metallic shell the insulator, which, in turn, retains the center electrode therein; an electrode-base-metal-disposing step for disposing the electrode base metal such that the contact portion provided on the electrode base metal is in contact with the front end portion of the insulator; a ground-electrode-joining step for, after the electrode-base-metal-disposing step, joining an outer peripheral portion of the electrode base metal of the ground electrode to the metallic shell; and a noble-metal-member-disposing step for disposing the noble-metal member in the communication section of the electrode base metal such that the outwardly projecting portion of the noble-metal member overlaps the inwardly projecting portion of the electrode base metal and is disposed frontward of the inwardly projecting portion with respect to the axial direction; and a noble-metal-member-joining step for joining the noble-metal member and the electrode base metal together.

According to the tenth aspect of the present invention, the electrode base metal is joined to the metallic shell in a state in which the electrode base metal is in contact with the front end portion of the insulator, thereby reliably closing a clearance between the ground electrode and the front end portion of the insulator. Since the noble-metal member is joined to the electrode base metal which is fixed to the metallic shell, no movable element is involved, thereby facilitating the joining process. The noble-metal member can be positioned by superposing the outwardly projecting portion of the noble-metal member on the inwardly projecting portion of the electrode base metal, thereby preventing off-axis disposition of the noble-metal member. As in the case of the aforementioned aspects of the present invention, before the electrode base metal is joined to the metallic shell, the insulator is retained in the metallic shell; therefore, an assembly error of the insulator is absorbed, thereby preventing breakage of the insulator.

According to an eleventh aspect of the present invention, there is provided a manufacturing method for a plasma jet spark plug which comprises a center electrode; an insulator having an axial bore extending in an axial direction, and retaining the center electrode within the axial bore in such a manner as to accommodate a front end face of the center electrode within a front end portion of the axial bore; a cavity formed in a front end portion of the insulator, in a form of a recess defined by a wall surface of the axial bore and a front end face of the center electrode; a metallic shell surrounding and retaining the insulator from outside with respect to a radial direction perpendicular to the axial direction; and a ground electrode disposed frontward of the front end portion of the insulator with respect to the axial direction and having a contact portion contacting the front end portion of the insulator in an annular contact zone such that, as viewed from the axial direction, an opening of the cavity is located internally of the contact portion, and a communication section for establishing communication between the cavity and an ambient atmosphere. The ground electrode is a composite member formed by joining an electrode base metal and a contact member together. The electrode base metal is not in contact with the insulator with respect to the axial direction, and is in contact with the metallic shell. The contact member has the contact portion. A portion of the electrode base metal and the contact member constitute the communication section. The manufacturing method comprises an insulator-retaining step for retaining in the metallic shell the insulator, which, in turn, retains the center electrode therein; an electrode-base-metal-disposing step for, after the insulator-retaining step, disposing the electrode base metal frontward of the front end portion of the insulator with respect to the axial direction; a ground-electrode-joining step for joining an outer peripheral portion of the electrode base metal of the ground electrode to the metallic shell; and a contact-member-disposing step for disposing the contact member in the communication section of the electrode base metal and moving the contact member along the axial direction so as to bring the contact portion in contact with the front end portion of the insulator; and a contact-member-joining step for joining the contact member to the electrode base metal in a state in which the contact portion remains in contact with the front end portion of the insulator.

According to the eleventh aspect of the present invention, first, the electrode base metal is joined to the metallic shell; then, in disposition of the contact member in the communication section of the electrode base metal, the contact member is adjusted in position so as to come into contact with the front end portion of the insulator; in this condition, the contact member is joined to the electrode base metal. By this procedure, a clearance between the ground electrode and the front end portion of the insulator can be reliably closed, irrespective of the position where the electrode base metal is disposed. As in the case of the aforementioned aspects of the present invention, before the electrode base metal is joined to the metallic shell, the insulator is retained in the metallic shell; therefore, an assembly error of the insulator is absorbed, thereby preventing breakage of the insulator.

According to a twelfth aspect of the present invention, in addition to the constitution of any one of the seventh to eleventh aspects of the present invention, the front end portion of the insulator has an engagement portion with which the contact portion provided on the ground electrode is engaged, and the contact portion is engaged with the engagement portion.

According to the twelfth aspect of the present invention, the contact portion of the ground electrode is engaged with the engagement portion provided at the front end portion of the insulator, whereby the ground electrode and the insulator can be reliably positioned in relation to each other, and a clearance between the ground electrode and the front end portion of the insulator can be closed more reliably.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENTS

Figure 1:
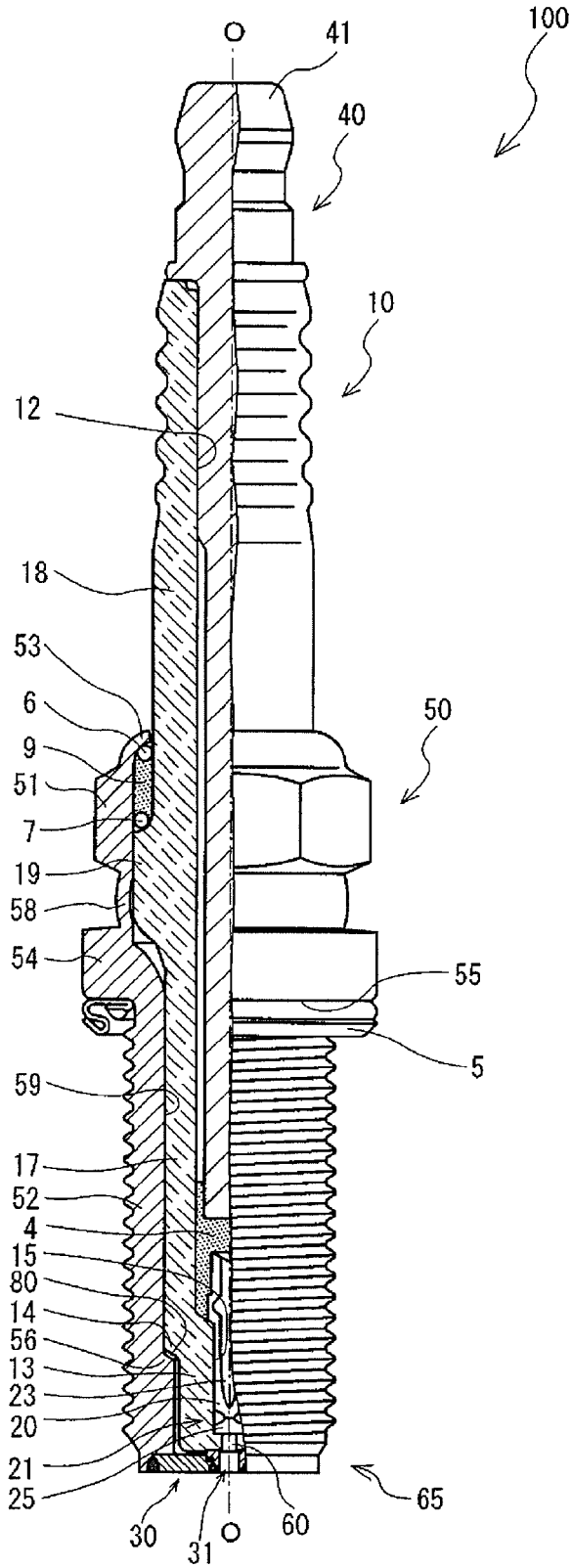
FIG. 1 is a partially sectional view of a plasma jet spark plug according to a first embodiment of the present invention.
Figure 2:
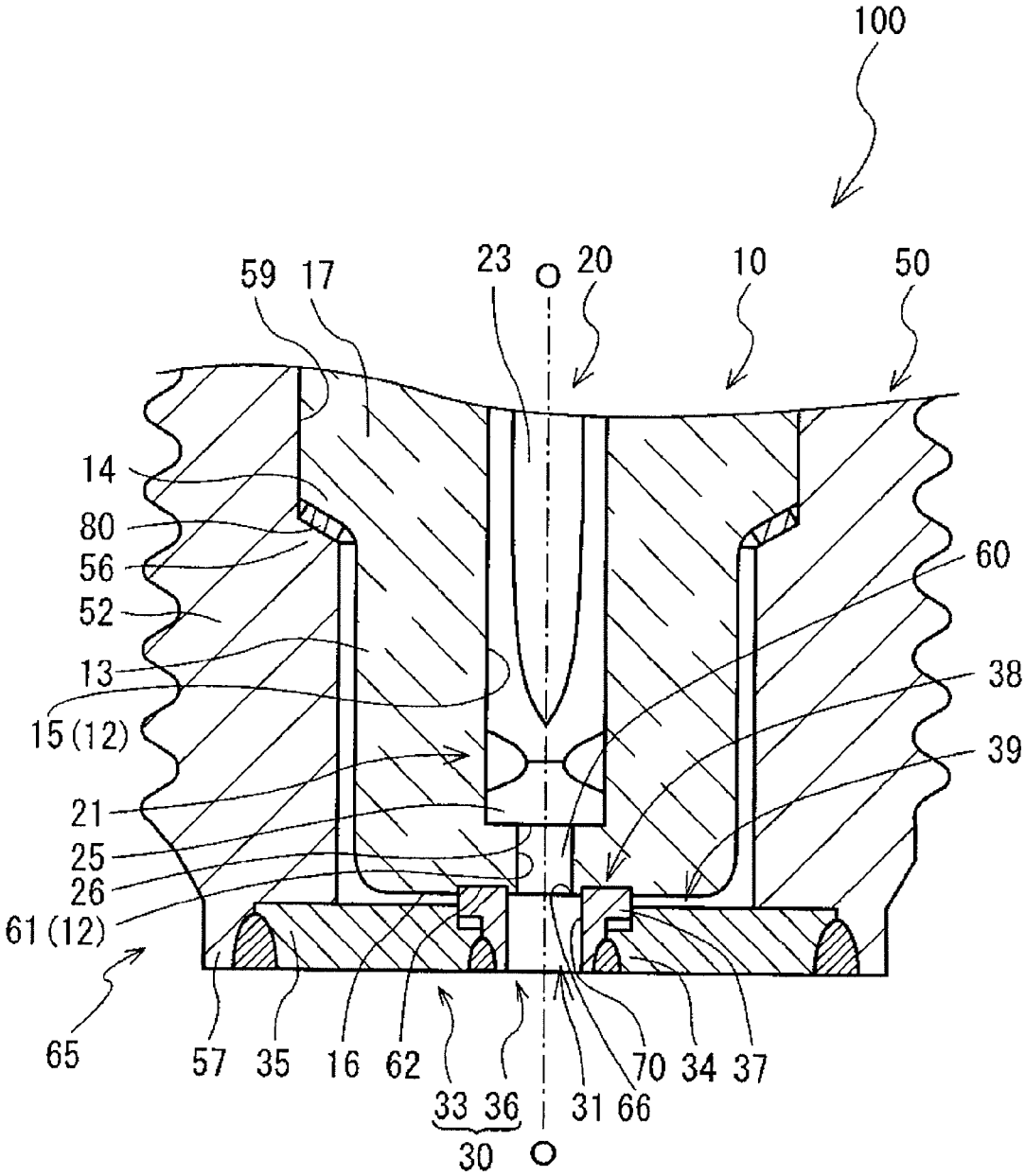
FIG. 2 is an enlarged sectional view of a front end portion of the plasma jet spark plug of the first embodiment.

Referring now to the drawings wherein the showings are for the purpose of illustrating a preferred embodiment of the invention only and not for the purpose of limiting same, a plasma jet spark plug 100 according to a first embodiment of the present invention will be described with reference to the drawings. First, the structure of the plasma jet spark plug 100 will be described with reference to FIGS. 1 and 2. FIG. 1 shows, partially in section, the plasma jet spark plug 100 of the first embodiment. FIG. 2 is a sectional view showing, on an enlarged scale, a front end portion of the plasma jet spark plug 100. In the following description, the direction of an axis O of the plasma jet spark plug 100 in FIG. 1 is referred to as the vertical direction, and the lower side of the plasma jet spark plug 100 in FIG. 1 is referred to as the front side of the plasma jet spark plug 100, and the upper side as the rear side of the plasma jet spark plug 100.

The plasma jet spark plug 100 of the first embodiment shown in FIG. 1 includes an insulator 10; a metallic shell 50 which retains the insulator 10; a center electrode 20 which is retained in the insulator 10 along the direction of the axis O; a ground electrode 30 welded to a front end portion 65 of the metallic shell 50; and a metal terminal 40 provided on a rear end portion of the insulator 10.

Insulator 10 is formed from alumina or the like by firing and is a tubular electrically insulative member having an axial bore 12 extending in the direction of the axis O. The insulator 10 has a flange portion 19 located substantially at the center with respect to the direction of the axis O and has a large outside diameter and a rear trunk portion 18 located rearward of the flange portion 19. The outer circumferential surface of a rear end portion of the rear trunk portion 18 is corrugated for increasing a creepage distance between the metallic shell 50 and the metal terminal 40. The insulator 10 also has a front trunk portion 17 located frontward of the flange portion 19. Front trunk portion 17 has an outside diameter smaller than that of the rear trunk portion 18. A leg portion 13 is located frontward of the front trunk portion 17 and has an outside diameter smaller than that of the front trunk portion 17. The insulator 10 further has a stepped portion 14 located between the leg portion 13 and the front trunk portion 17.

A portion of the axial bore 12 which corresponds to an inner circumferential portion of the leg portion 13 is formed as an electrode-accommodating portion 15. Electrode-accommodating portion 15 is smaller in diameter than the remaining portion of the axial bore 12 which corresponds to inner circumferential portions of the front trunk portion 17, the flange portion 19, and the rear trunk portion 18. The electrode-accommodating portion 15 retains the center electrode 20 therein. As shown in FIG. 2, a portion of the axial bore 12 which is located frontward of the electrode-accommodating portion 15 is further reduced in diameter so as to serve as a front-end small-diameter portion 61. The front-end small-diameter portion 61 opens at a front end portion 16 of the insulator 10. The front end portion 16 of the insulator 10 has an annular chip engagement portion 62, which surrounds the opening of the front-end small-diameter portion 61 and assumes the form of a recess. An outwardly projecting portion 37 of a noble-metal chip or element 36, which will be described later, is engaged with the chip engagement portion 62.

The center electrode 20 is a columnar electrode rod formed from a nickel alloy, such as INCONEL™ 600 or 601. The center electrode 20 has a metal core 23 formed from a material having excellent thermal conductivity, such as copper. A disk-like electrode chip 25, formed from an alloy which predominantly contains a noble metal and tungsten (W), is welded to a front end portion 21 of the center electrode 20 so that the electrode chip or tip 25 is integrated with the center electrode 20. In the first embodiment, the "center electrode" encompasses the electrode chip or tip 25 welded to the center electrode 20.

As shown in FIG. 1, a portion of the center electrode 20 which is located toward the rear end of the center electrode 20 is increased in diameter, thereby assuming the form of a flange. The flange portion of the center electrode 20 abuts a stepped region of the electrode-accommodating portion 15 of the axial bore 12, whereby the center electrode 20 is positioned within the electrode-accommodating portion 15. As shown in FIG. 2, a circumference, i.e., a peripheral edge, of a front end face 26 of the front end portion 21 of the center electrode 20 (more specifically, a circumference of the front end face 26 of the electrode chip 25, which is joined to the center electrode 20 at the front end portion 21 of the center electrode 20) abuts a stepped portion of the axial bore 12 which is located and formed between the electrode-accommodating portion 15 and the front-end small-diameter portion 61, which differ in diameter. Through employment of this configuration, the inner wall surface of the front-end small-diameter portion 61 of the axial bore 12 and the front end face 26 of the center electrode 20 define a discharge space, which assumes a closed-bottomed, cylindrical shape and has a small volume. In the plasma jet spark plug 100, spark discharge is performed across a spark discharge gap formed between the ground electrode 30 and the center electrode 20. The path of spark discharge extends through the discharge space. The discharge space is referred to as cavity 60. At the time of spark discharge, plasma is generated in the cavity 60, i.e., the discharge space, and is emitted frontward from an opening 66 of the front end portion 16. The cavity 60 may be formed in such a manner as to encompass a portion of the electrode-accommodating portion 15, which is located rearward of the front-end small-diameter portion 61 and has a diameter greater than that of the frontend small-diameter portion 61.

As shown in FIG. 1, the center electrode 20 is electrically connected, within the front trunk portion 17 of insulator 10, to the metal terminal 40 via an electrically conductive seal substance 4, which is a mixture of metal and glass and is provided in the axial bore 12. The seal substance 4 fixes the center electrode 20 and the metal terminal 40 in the axial bore 12 while establishing electrical connection therebetween. The metal terminal 40 extends rearward in the axial bore 12, and a rear end portion 41 of the metal terminal 40 projects to the exterior of the insulator 10 from the rear end of the insulator 10. A high-voltage cable (not shown) is connected to the rear end portion 41 via a plug cap (not shown), and a high voltage is applied to the rear end portion 41 from an ignition device (not shown).

Next, the metallic shell 50 will be described. The metallic shell 50 is a tubular metal member for fixing the plasma jet spark plug 100 to an engine head (not shown) of an internal combustion engine. The metallic shell 50 surrounds a region of the insulator 10 ranging from the leg portion 13 to a front end portion of the rear trunk portion 18, thereby retaining the insulator 10 in a tubular bore 59 thereof. The metallic shell 50 is formed from a low-carbon steel and has an attachment portion 52 extending frontward substantially from an axially central region of the metallic shell 50. External threads are formed on the outer circumferential surface of the attachment portion 52 for engagement with internal threads formed on the wall surface of an attachment hole (not shown) of the engine head. In view of thermal resistance, stainless steel, INCONEL™, or the like may be used to form the metallic shell 50.

A flange-like seal portion 54 is formed on the rear side of the attachment portion 52. An annular gasket 5, which is formed by bending a sheet material, is fitted to a region located between the seal portion 54 and the attachment portion 52. When the plasma jet spark plug 100 is attached to the attachment hole (not shown) of the engine head, the gasket 5 is squeezed and deformed between a seat face 55, which is a front-oriented face of the seal portion 54, and a surface of the engine head around the opening of the attachment hole, thereby providing a seal therebetween for preventing outflow of combustion gas through the attachment hole.

A tool engagement portion 51 is formed on the rear side of the seal portion 54 to allow an unillustrated plug wrench to be fitted to the tool engagement portion 51. A thin-walled crimp portion 53 is provided on the rear side of the tool engagement portion 51. A thin-walled buckle portion 58 is provided between the tool engagement portion 51 and the seal portion 54. Annular ring members 6, 7 are disposed between an inner circumferential surface of the metallic shell 50 ranging from the tool engagement portion 51 to the crimp portion 53 and an outer circumferential surface of the rear trunk portion 18 of the insulator 10. Furthermore, a space between the annular ring members 6, 7 is filled with a powder of talc 9.

As shown in FIG. 2, the inner circumferential surface of the attachment portion 52 has a stepped portion 56. The stepped portion 14 of the insulator 10 rests on the stepped portion 56 via an annular packing 80. As shown in FIG. 1, when an end portion of the crimp portion 53 is crimped in such a manner as to be bent radially inward, the insulator 10 is pressed frontward via the ring members 6, 7 and the talc 9. In this process of crimping, the buckle portion 58 is heated and deformed bulgingly in association with application of a compressive force, thereby increasing the stroke of compression of the crimp portion 53. By this procedure, a portion of the insulator 10 ranging from the stepped portion 14 to the flange portion 19 is held between the crimp portion 53 and the stepped portion 56 of the metallic shell 50, whereby the insulator 10 is unitarily retained by the metallic shell 50. The packing 80 provides an airtight seal between the metallic shell 50 and the insulator 10, thereby preventing outflow of combustion gas through the tubular bore 59.

Next will be described the ground electrode 30 which is disposed in the front end portion 65 of the metallic shell 50. The ground electrode 30 shown in FIG. 2 is a composite member formed by joining together an electrode base metal 33 of a nickel alloy and the noble-metal chip 36 of a noble metal. The ground electrode 30 assumes a disk-like form and has a communication hole (communication section 31) formed at the radial center thereof. The noble-metal chip 36 is disposed radially inside of and is joined to the electrode base metal 33. An outer peripheral portion 35 of the ground electrode 30 (i.e., an outer peripheral portion 35 of the electrode base metal 33) is engaged with a stepped engagement portion 57 formed on the inner circumferential surface of the front end portion 65 of the metallic shell 50. In the thus engaged condition, the interface therebetween undergoes laser welding, whereby the ground electrode 30 and the metallic shell 50 are joined together. The electrode base metal 33 and the noble-metal chip 36 cooperatively form the communication section 31 of the ground electrode 30. The communication section 31 has an opening for establishing communication between the cavity 60 and an ambient atmosphere. The term "outer peripheral portion" denotes a portion of the ground electrode 30 which is joined to the metallic shell 50. In the first embodiment, the ground electrode 30 assumes a disk-like form; thus, a radially outer circumferential portion of the ground electrode 30 corresponds to the "outer peripheral portion." Even when the ground electrode 30 assumes a form other than the disk-like form, a radially outer peripheral portion of the ground electrode 30 is joined to the metallic shell 50.

The noble-metal chip or insert 36 of the first embodiment assumes a tubular form and constitutes a portion of the communication section 31; specifically, forms an inner circumferential wall 70 of the communication section 31. The noble-metal chip 36 has an outwardly projection portion 37, which projects radially outward in a flange-like form from an outer circumferential surface of a rear end portion of the noble-metal chip or insert 36. The electrode base metal 33 assumes a disk-like form and has a hole at the radial center thereof, the hole partially constituting the communication section 31. As with the noble-metal chip 36, the electrode base metal 33 has an inwardly projecting portion 34, which projects radially inward in a flange-like form from a front end portion of the wall of the hole of the electrode base metal 33. The outwardly projecting portion 37 of the noble-metal chip 36 is disposed rearward of the inwardly projecting portion 34 of the electrode base metal 33. By virtue of this configuration, even when deterioration arises in joining between the electrode base metal 33 and the noble-metal chip or insert 36, there can be prevented frontward falling-off of the noble-metal chip 36.

The front end portion 16 of the insulator 10 has a chip engagement portion 62, which is a recess formed on the front end face of the insulator 10 that is dimensioned to engage with the outwardly projecting portion 37 of the noble-metal chip 36. The chip engagement portion 62 is formed annularly in such a manner as to surround the opening 66 of the cavity 60. The outwardly projecting portion 37 of the noble-metal chip 36 is engaged with the chip engagement portion 62, thereby being in an annular contact with the front end portion 16 of the insulator 10. A portion of the outwardly projecting portion 37, which is engaged with the chip engagement portion 62 and is in contact with the front end portion 16 of the insulator 10 in an annular contact zone, is a contact portion 38. As viewed from the direction of the axis O, the opening 66 of the cavity 60 is located internally of the contact portion 38. A noncontact portion 39 of the electrode base metal 33 is provided at the rear side of the electrode base metal 33 and faces the front end portion 16 of the insulator 10 without contacting the front end portion 16. The noble-metal chip 36 closes a clearance between the ground electrode 30 and the front end portion 16 of the insulator 10 and a clearance between the metallic shell 50 and the front end portion 16 of the insulator 10 which communicates with the former clearance, and establishes communication between the cavity 60 and an ambient atmosphere. At the time of outward emission of plasma generated within the cavity 60, this configuration prevents leakage of energy of plasma into the clearance between the ground electrode 30 and the front end portion 16 of the insulator 10 and into the clearance between the insulator 10 and the metallic shell 50. The noble-metal chip 36 corresponds to the "contact member" and the "noble-metal member" in the present invention.

Figure 3:
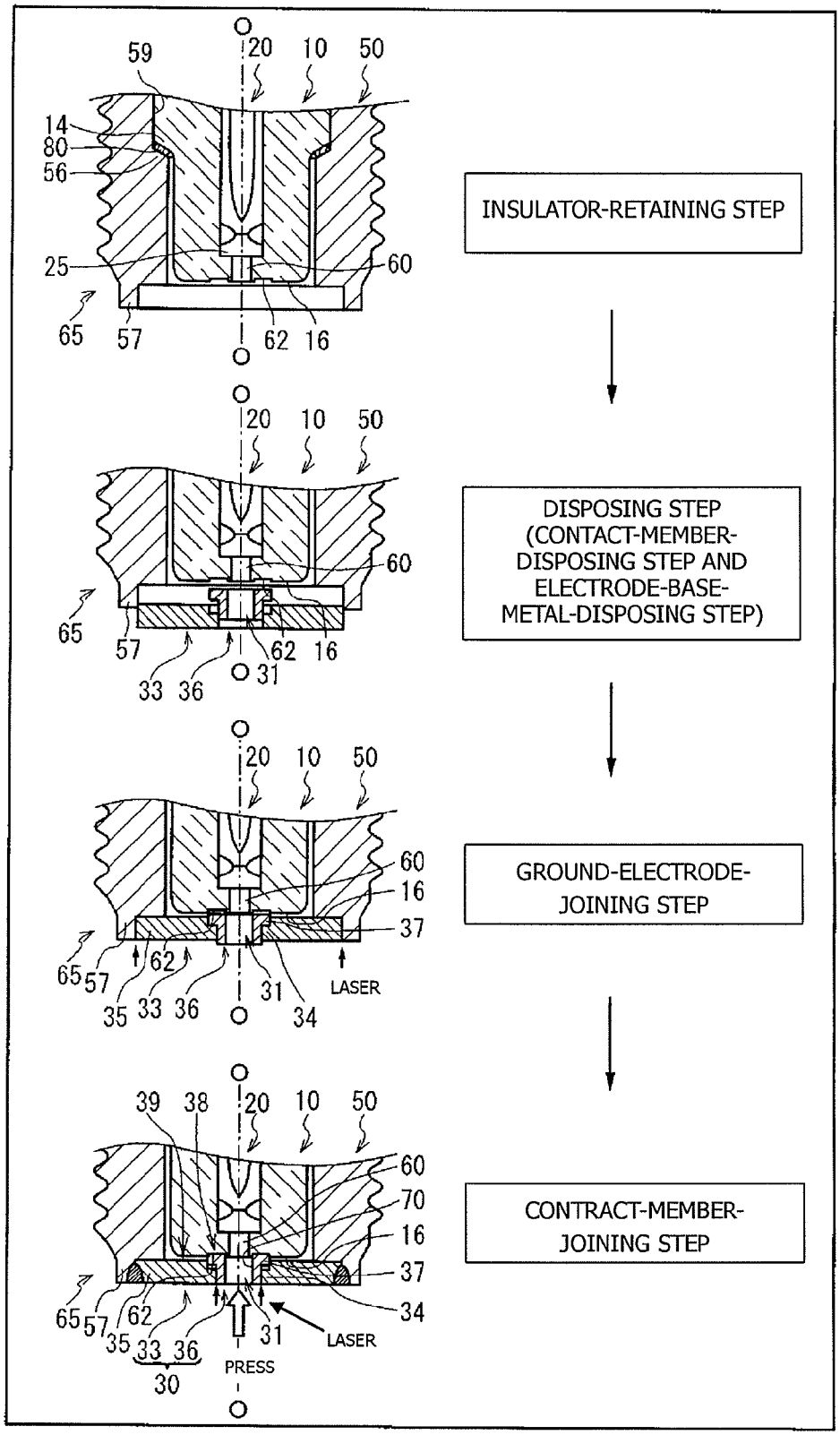
FIG. 3 is a diagram showing a portion of a manufacturing process for the plasma jet spark plug of the first embodiment.

In the process of manufacturing the thus-configured plasma jet spark plug 100 of the first embodiment, in order to close the clearance between the ground electrode 30 and the front end portion 16 of the insulator 10 and the clearance between the insulator 10 and the metallic shell 50 for preventing leakage of energy of plasma into such clearances at the time of emission of plasma, before the ground electrode 30 is joined to the metallic shell 50, the insulator 10 is retained in the metallic shell 50. A manufacturing method for the plasma jet spark plug 100 will next be described with reference to FIG. 3. FIG. 3 partially shows a manufacturing process for the plasma jet spark plug 100 of the first embodiment.

In the manufacturing process for the plasma jet spark plug 100, the insulator 10, which has been prepared in a separate step in such a condition that the center electrode 20 (having the electrode chip or tip element 25 joined thereto) and the metal terminal 40 are attached thereto, is inserted into the tubular bore 59 of the metallic shell 50, which has been prepared in a separate step. The stepped portion 14 of the insulator 10 is caused to rest on the stepped portion 56 of the tubular bore 59 of the metallic shell 50 via the packing 80. In this condition, the crimp portion 53 (see FIG. 1) of the metallic shell 50 is crimped, whereby a portion of the insulator 10 ranging from the stepped portion 14 to the flange portion 19 is held between the crimp portion 53 and the stepped portion 56 of the metallic shell 50, and thus the insulator 10 is unitarily retained in the metallic shell 50 (insulator-retaining step).

Next, the tubular noble-metal chip or insert 36 having the outwardly projecting portion 37 is disposed frontward of the front end portion 16 of the insulator 10 in such a manner that the outwardly projecting portion 37 faces the insulator 10 (contact-member-disposing step in a disposing step). At this time, the noble-metal chip 36 is disposed at such a position that the outwardly projecting portion 37 faces the chip engagement portion 62 of the front end portion 16 of the insulator 10. Furthermore, the disk-like electrode base metal 33 having a hole where the inwardly projecting portion 34 projects is disposed frontward of the front end portion 16 of the insulator 10 in such a manner that the inwardly projecting portion 34 is located frontward of the outwardly projecting portion 37 of the noble-metal chip 36 and that the inwardly projecting portion 34 and the outwardly projecting portion 37 overlap each other with respect to the direction of the axis O (electrode-base-metal-disposing step in the disposing step). The outer peripheral portion 35 of the electrode base metal 33 is fitted to and engaged with the stepped engagement portion 57 of the metallic shell 50. At this time, the noncontact portion 39 of the electrode base metal 33 is maintained in a state in which it is not in contact with the front end portion 16 of the insulator 10. The noble-metal chip 36 is disposed in such a positionally restrained manner that the outwardly projecting portion 37 intervenes between the inwardly projecting portion 34 of the electrode base metal 33 and the chip engagement portion 62 of the insulator 10.

The interface between the outer peripheral portion 35 of the electrode base metal 33 and the stepped engagement portion 57 of the metallic shell 50 is irradiated with a laser beam along the entire circumference of the interface, thereby welding together the metallic shell 50 and the electrode base metal 33 of the ground electrode 30 (ground-electrode-joining step). At this time, the noble-metal chip 36 is in an unfixed condition. In the next step, the noble-metal chip 36 is pressed rearward such that the outwardly projecting portion 37 is engaged with the chip engagement portion 62 of the insulator 10, whereby the noble-metal chip 36 is positioned. By this procedure, off-axis disposition of the noble-metal chip 36 is prevented. Furthermore, since the noble-metal chip 36 is pressed rearward, the noble-metal chip 36 and the chip engagement portion 62 are brought into close contact with each other, thereby closing a clearance between the noble-metal chip 36 and the front end portion 16 of the insulator 10 and a clearance between the electrode base metal 33, which partially constitutes the ground electrode 30, and the front end portion 16 of the insulator 10. While the noble-metal chip 36 remains in a pressed condition, the interface between the noble-metal chip 36 and the electrode base metal 33 is irradiated with a laser beam along the entire circumference of the interface, whereby the noble-metal chip 36 and the electrode base metal 33 are welded together (contact-member-joining step). The noble-metal chip 36 and the electrode base metal 33 unitarily form the communication section 31.

By the above-described procedure, the ground electrode 30 is joined to the front end portion 65 of the metallic shell 50, thereby completing the plasma jet spark plug 100 shown in FIG. 1. As mentioned above, before the ground electrode 30 is joined to the metallic shell 50, the insulator 10 is retained in the metallic shell 50 by crimping; therefore, in the crimping process, no object abuts the front end portion 16 of the insulator 10, thereby preventing the front end portion 16 of the insulator 10 from being subjected to a strong external pressing force. In the manufacturing process, when the insulator 10 is retained in the metallic shell 50 by crimping, a displacement of the front end portion 16 of the insulator 10 along the direction of the axis O may arise; i.e., an assembly error may increase. Even in such a case, in the step of joining the electrode base metal 33 to the metallic shell 50, such an assembly error can be absorbed by a clearance along the direction of the axis O between the electrode base metal 33 and the front end portion 16 of the insulator 10.

Furthermore, a clearance which may be formed between the electrode base metal 33 of the ground electrode 30 and the front end portion 16 of the insulator 10 can be closed by bringing the noble-metal chip 36, which has a portion of the communication section 31 and the contact portion 38, into contact with the front end portion 16 of the insulator 10. Accordingly, energy of plasma does not leak into the above-mentioned clearance, whereby impairment in ignition performance can be prevented. Also, since the noble-metal chip 36 is positioned such that the outwardly projecting portion 37 overlaps the inwardly projecting portion 34 of the electrode base metal 33 with respect to the direction of the axis O, in a manufacturing process ranging from disposition of the electrode base metal 33 to joining of the noble-metal chip 36, the noble-metal chip 36 does not fall off. Even when deterioration arises with respect to a joined condition between the noble-metal chip 36 and the electrode base metal 33 as a result of long-term use of the plasma jet spark plug 100, dropping-off of the noble-metal chip 36 can be prevented, since the noble-metal chip 36 is retained by the inwardly projecting portion of the electrode base metal 33.

Figure 4:
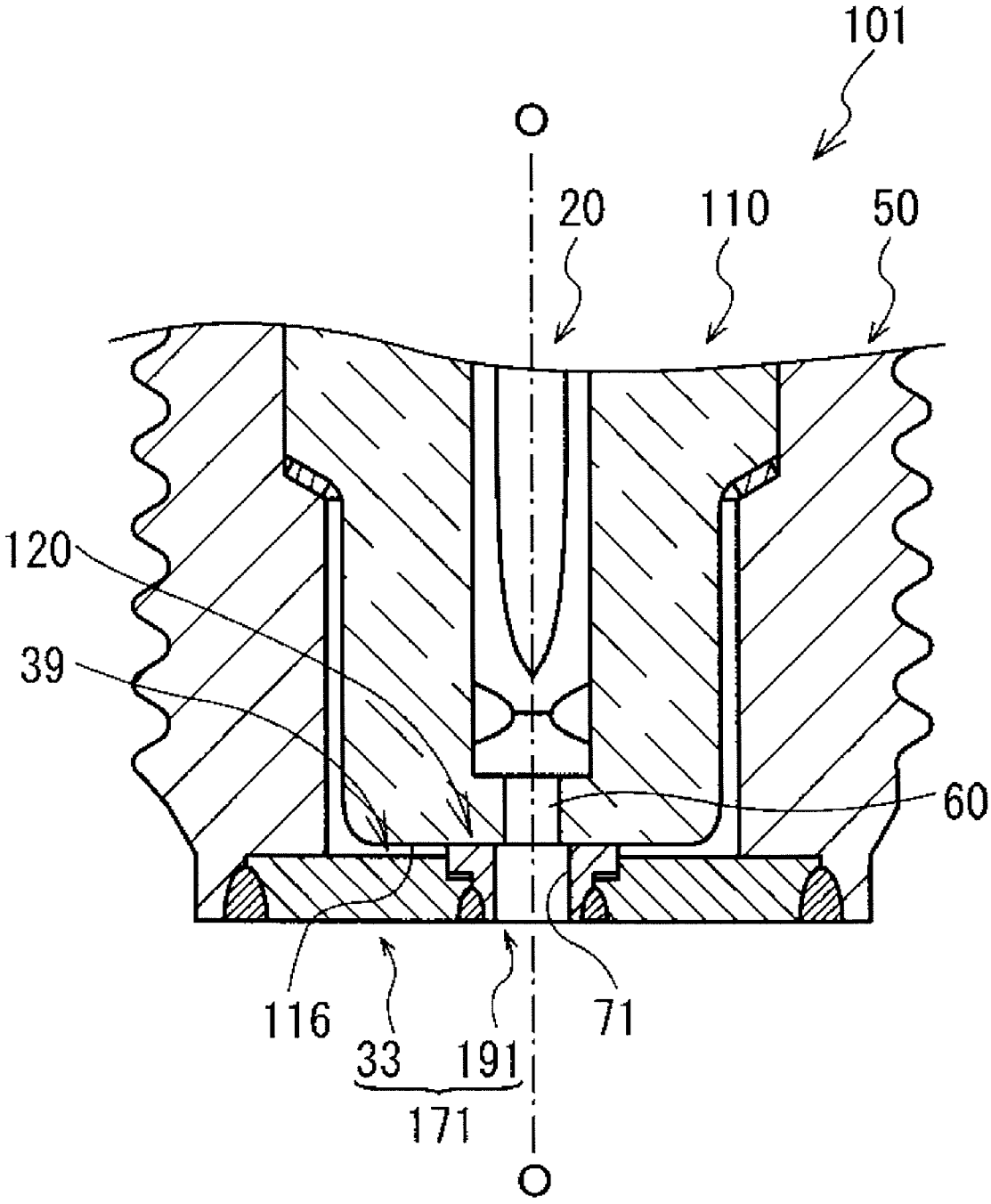
FIG. 4 is an enlarged sectional view of a front end portion of a plasma jet spark plug according to a modification of the first embodiment.

The plasma jet spark plug 100 of the first embodiment can be modified in various other forms. For example, as in the case of a plasma jet spark plug 101 shown in FIG. 4, a front end portion 116 of an insulator 110 may not have a chip engagement portion. A clearance between a ground electrode 171 (electrode base metal 33) and the front end portion 116 of the insulator 110 can be closed in a sufficiently satisfactory condition by carrying out the process of joining a noble-metal chip 191 to the electrode base metal 33 by laser welding, in such a manner that the noble-metal chip 191 is pressed rearward so as to bring a contact portion 120 of the noble-metal chip 191 into contact with the front end portion 116 of the insulator 110.

Figure 5:
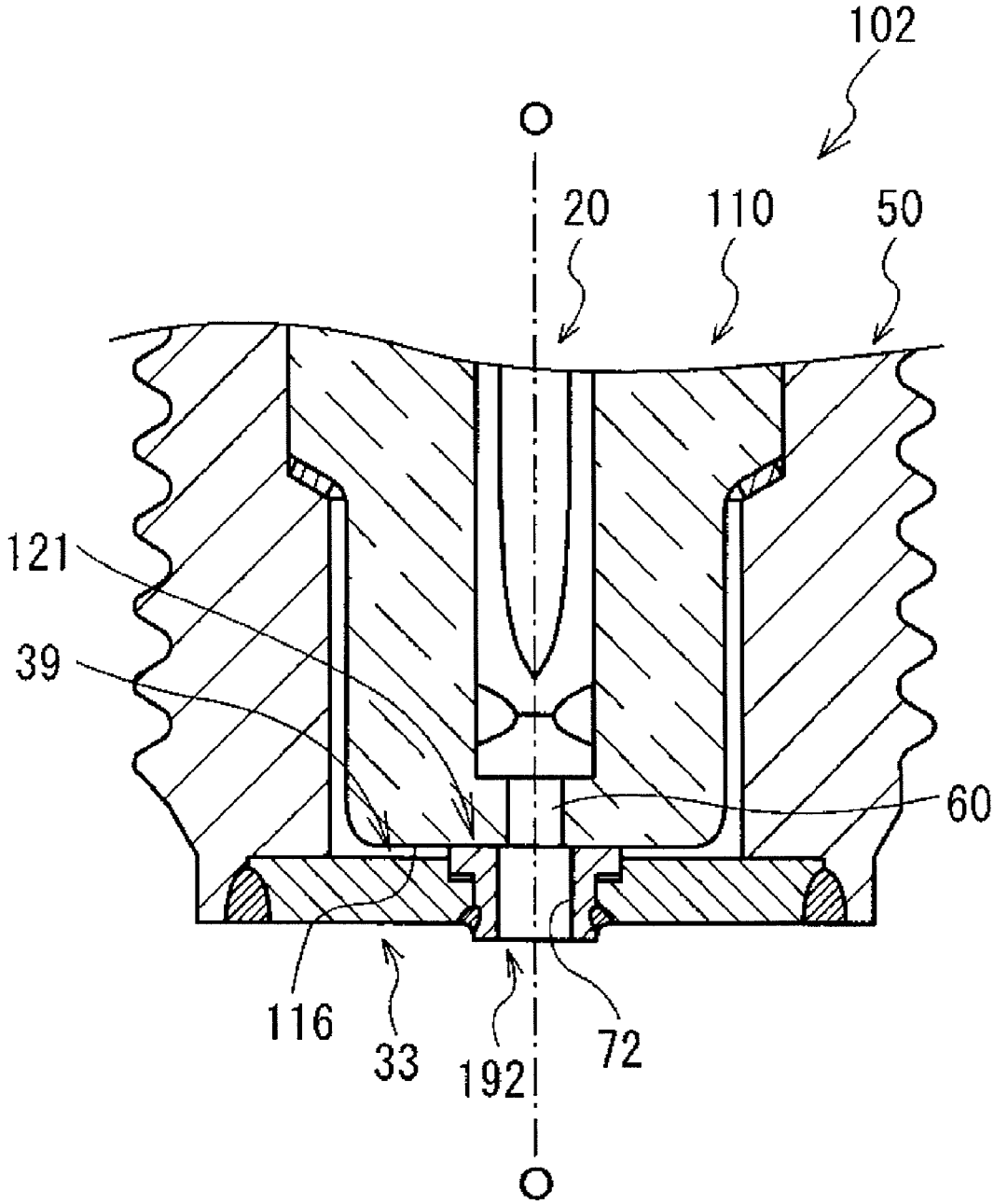
FIG. 5 is an enlarged sectional view of a front end portion of a plasma jet spark plug according to another modification of the first embodiment.
Figure 6:
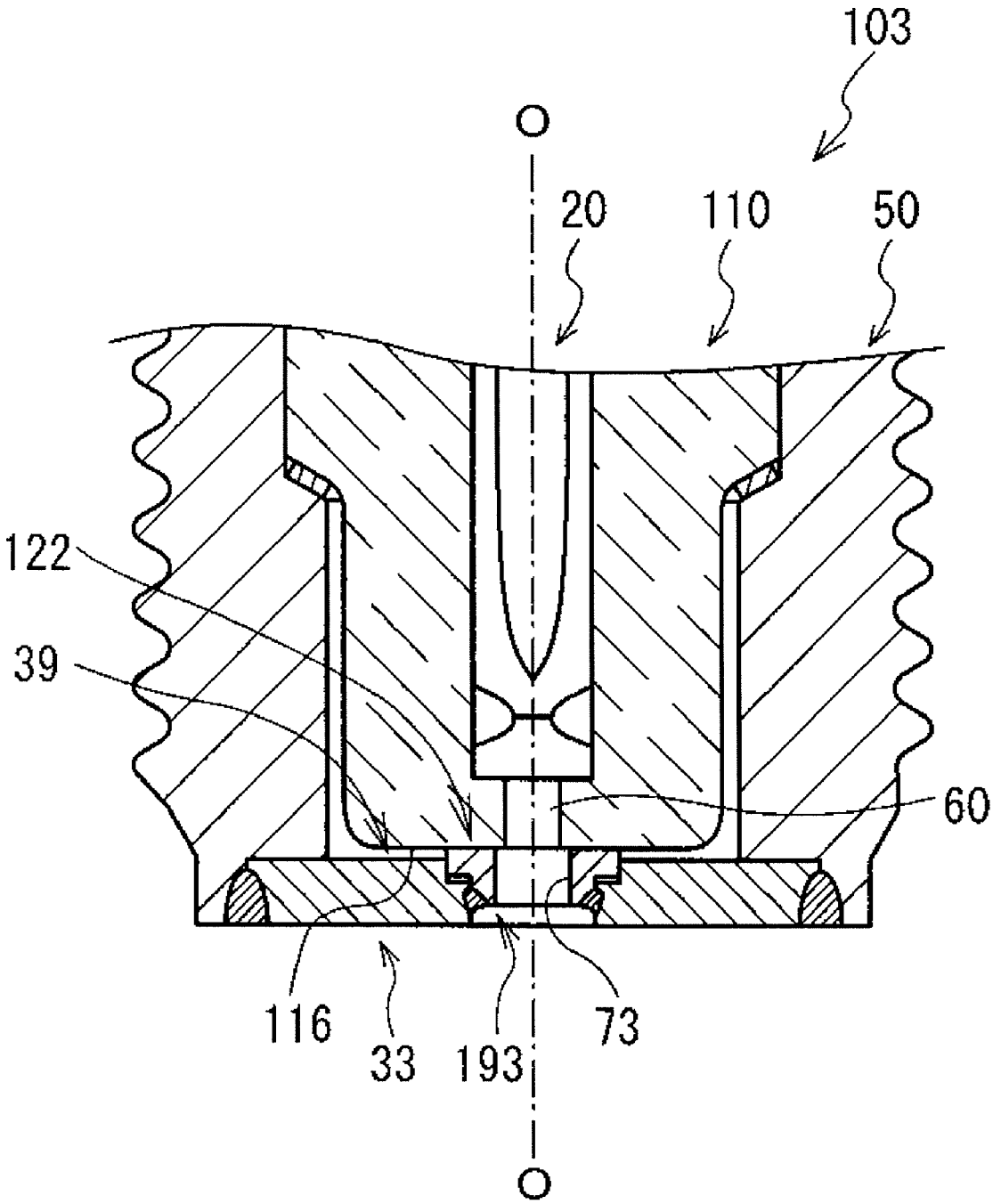
FIG. 6 is an enlarged sectional view of a front end portion of a plasma jet spark plug according to still another modification of the first embodiment.

Furthermore, as in the case of a plasma jet spark plug 102 and a plasma jet spark plug 103 shown in FIGS. 5 and 6, respectively, the length of a noble-metal chip 192, 193 along the direction of the axis O may be lengthened or shortened. This imparts a stepped geometry to an interfacial region between the noble-metal chip 192, 193 and the electrode base metal 33. In the process of laser-welding the noble-metal chip 192, 193 and the electrode base metal 33 in a state in which the contact portion 121, 122 of the noble-metal chip 192, 193 is in contact with the front end portion 116 of the insulator 110, the stepped geometry facilitates application of a laser beam to the interface therebetween from an acute angle with respect to the axis O. This prevents penetration of a laser beam into a clearance between the mating surfaces of the noble-metal chip 192, 193 and the electrode base metal 33, thereby establishing a more reliably joined condition.

Figure 7:
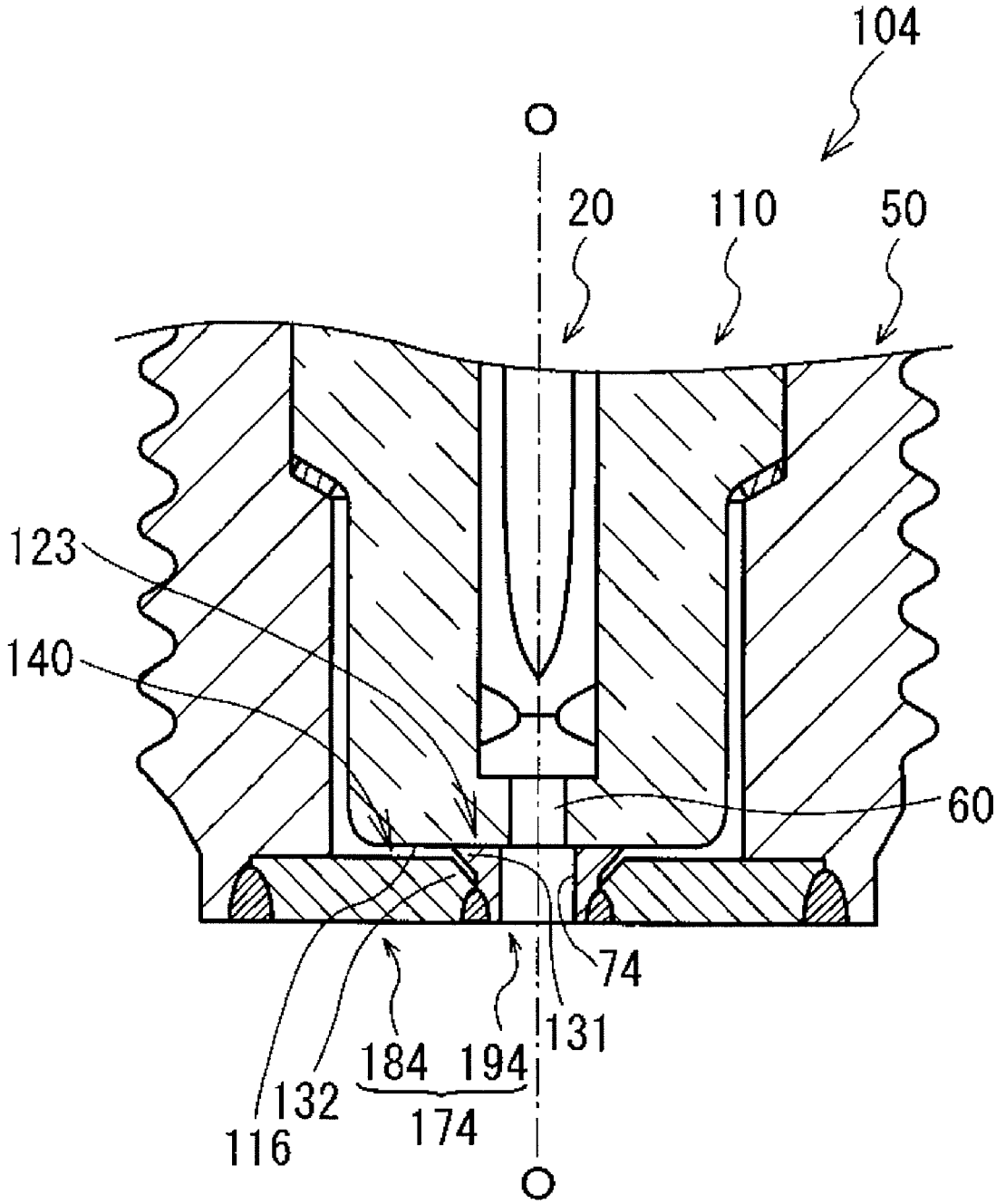
FIG. 7 is an enlarged sectional view of a front end portion of a plasma jet spark plug according to still another modification of the first embodiment.

As in the case of a plasma jet spark plug 104 shown in FIG. 7, an outwardly projecting portion 131 of a noble-metal chip 194 may assume such a taper form as to increase in diameter rearward. In this case, a hole of an electrode base metal 184 has a taper portion 132, which overlaps the outwardly projecting portion 131 with respect to the direction of the axis O. By virtue of this, in a manufacturing process ranging from disposition of the electrode base metal 184 to joining of the noble-metal chip 194, the noble-metal chip 194 does not fall off.

Figure 8:
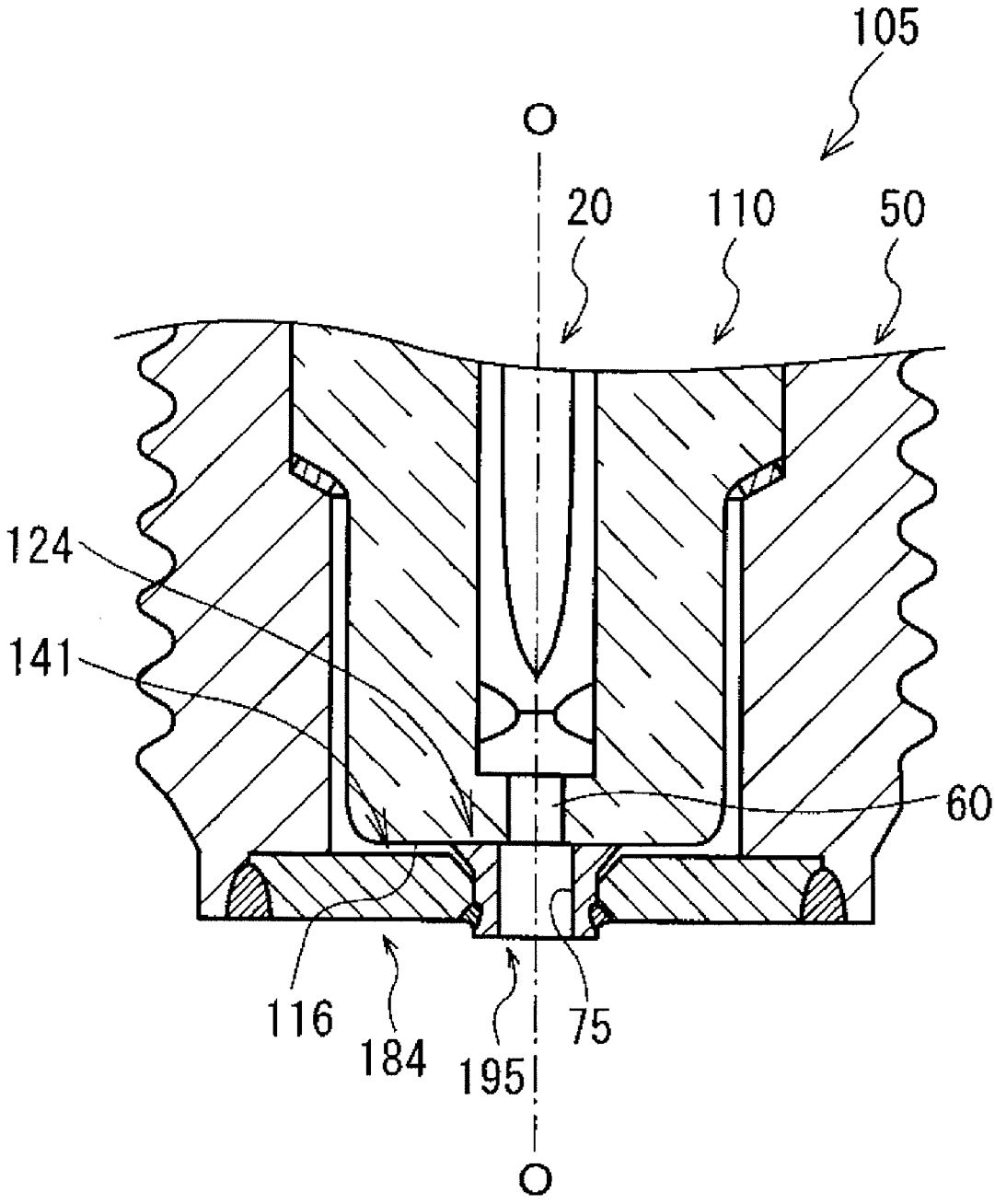
FIG. 8 is an enlarged sectional view of a front end portion of a plasma jet spark plug according to still another modification of the first embodiment.
Figure 9:
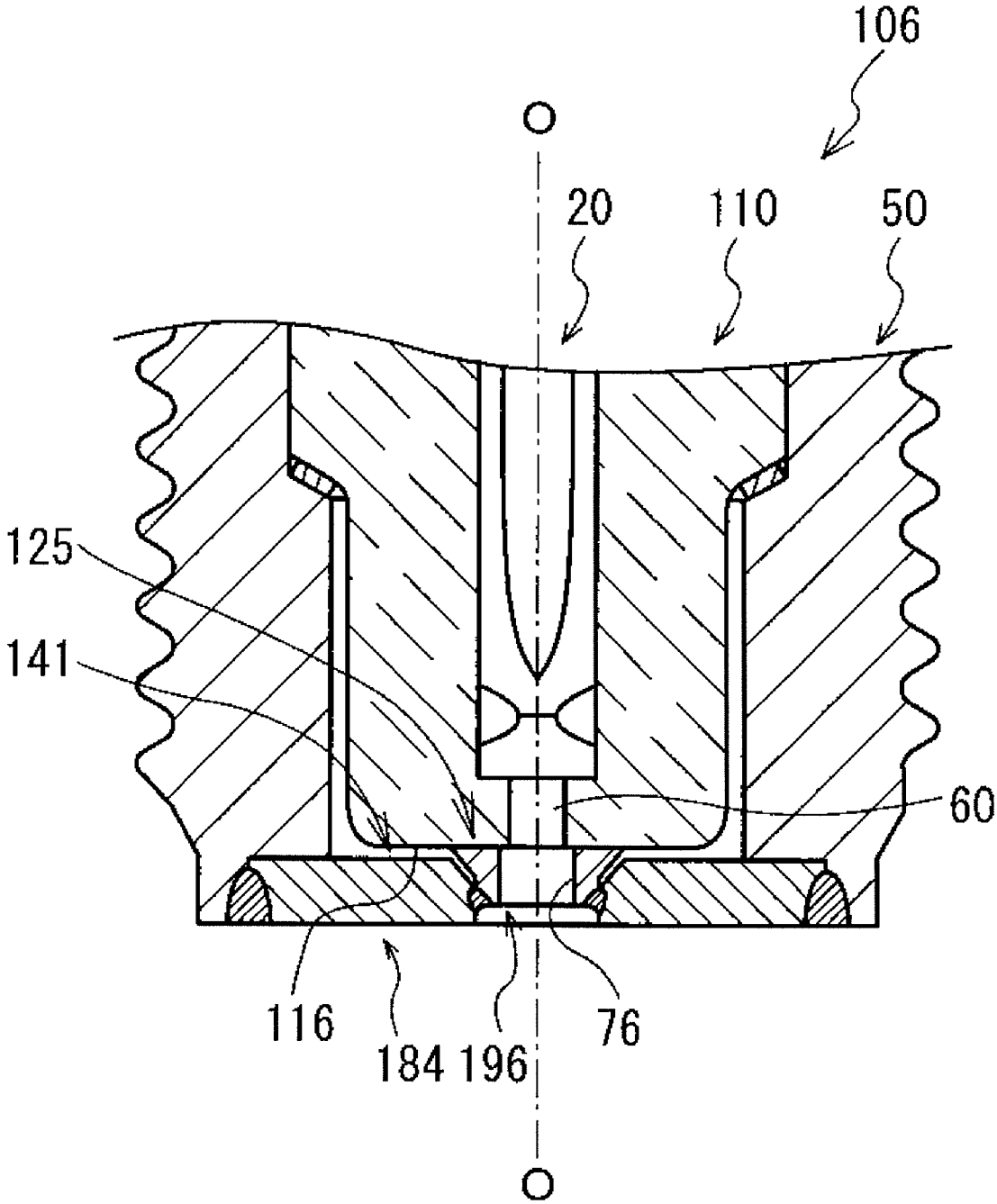
FIG. 9 is an enlarged sectional view of a front end portion of a plasma jet spark plug according to still another modification of the first embodiment.

Even in the case of using a noble-metal chip having a tapered, outwardly projecting portion, as shown in FIGS. 8 and 9 showing a plasma jet spark plug 105 and a plasma jet spark plug 106, respectively, the length of a noble-metal chip 195, 196 along the direction of the axis O may be lengthened or shortened. This imparts a stepped geometry to an interfacial region between the noble-metal chip 195, 196 and the electrode base metal 184. In the process of laser-welding the noble-metal chip 195, 196 and the electrode base metal 184 in a state in which the contact portion 124, 125 of the noble-metal chip 195, 196 is in contact with the front end portion 116 of the insulator 110, the stepped geometry facilitates application of a laser beam to the interface therebetween from an acute angle with respect to the axis O. This can establish a more reliably joined condition.

Figure 10:
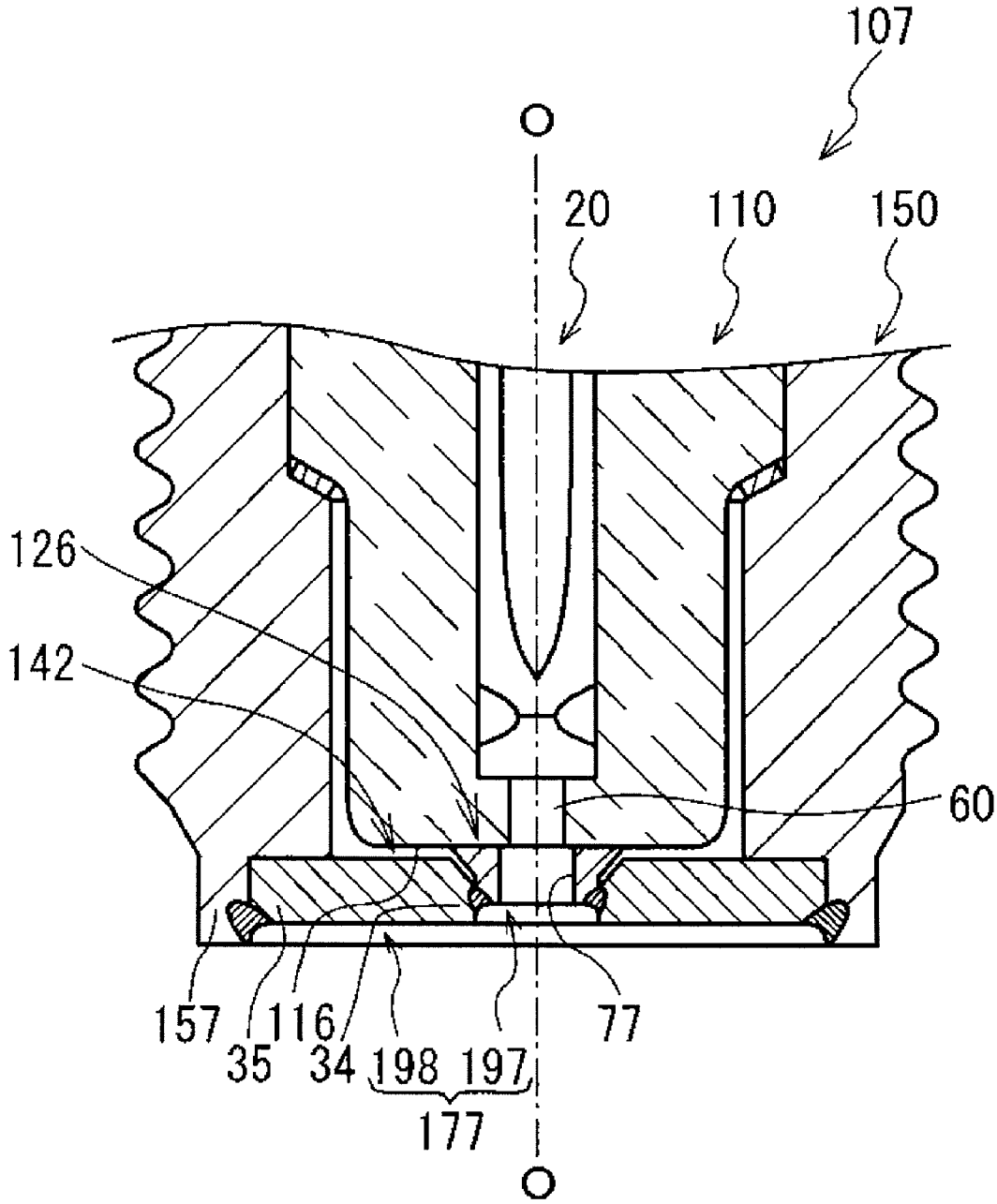
FIG. 10 is an enlarged sectional view of a front end portion of a plasma jet spark plug according to still another modification of the first embodiment.

As in a plasma jet spark plug 107 shown in FIG. 10, a noble-metal chip 197 may not have an outwardly projecting portion, so long as the outer periphery of the noble-metal chip 197 is located radially outward of the inwardly projecting portion 34 of the electrode base metal 33. Even in this case, similarly to the first embodiment, dropping-off of the noble-metal chip 197 can be prevented. Of course, a joining process may be carried out in a manner similar to that of the first embodiment; specifically, after the electrode base metal 33 is jointed to a metallic shell 150, while the noble-metal chip 197 is pressed rearward for maintaining a contact portion 126 of the noble-metal chip 197 in contact with the front end portion 116 of the insulator 110, the electrode base metal 33 and the noble-metal chip 197 are joined together. Alternatively, the ground-electrode-joining step may be carried out such that, while the electrode base metal 33 is pressed rearward, and the noble-metal chip 197 is brought into contact with the front end portion 116 of the insulator 110, the outer peripheral portion 35 of the electrode base metal 33 is joined to a stepped engagement portion 157 of the metallic shell 150. By this procedure, the electrode base metal 33 can be disposed closer to the insulator 110; thus, a stepped geometry can be imparted to an interfacial region between the stepped engagement portion 157 of the metallic shell 150 and the outer peripheral portion 35 of the electrode base metal 33. Therefore, for the reason mentioned previously, a more reliably joined condition can be established.

In the above-described modifications shown in FIGS. 7 to 10, the ground electrode 174, 177 (not shown in FIGS. 8 and 9) may be joined to the metallic shell 50 by the steps similar to those of the first embodiment. This procedure allows a clearance between the electrode base metal 174, 184, 198 (noncontact portion 140, 141, 142) and the front end portion 116 of the insulator 110 to absorb an assembly error along the direction of the axis O which may arise in the process of retaining the insulator 110 in the metallic shell 50. Thus, in a state in which the front end portion 116 of the insulator 110 is not subjected to a strong, external, pressing force, a clearance between the front end portion 116 and the ground electrode 174, 177 can be closed by the noble-metal chip 194, 195, 196, 197. As in the case of the plasma jet spark plugs 101 to 105 shown in FIGS. 4 to 8, the inner circumferential wall of the noble-metal chip 191, 192, 193, 194, 195 may serve as an inner circumferential wall 71, 72, 73, 74, 75 of a communication section. As in the case of the plasma jet spark plugs 106 and 107 shown in FIGS. 9 and 10, the inner circumferential wall of the noble-metal chip 196, 197 may partially constitute an inner circumferential wall 76, 77 of the communication section.

In the first embodiment, the outwardly projecting portion 37 is provided in a flange-like form on the tubular noble-metal chip 36. However, the outwardly projecting portion 37 does not necessarily assume a continuous flange-like form, but may assume the form of a mere projection. This also applies to the inwardly projecting portion 34 of the electrode base metal 33. No particular limitation is imposed on the shape of the outwardly projecting portion 37 and the inwardly projecting portion 34, so long as, when the noble-metal chip 36 and the electrode base metal 33 are joined together, the outwardly projecting portion 37 and the inwardly projecting portion 34 overlap each other with respect to the direction of the axis O.

Figure 11:
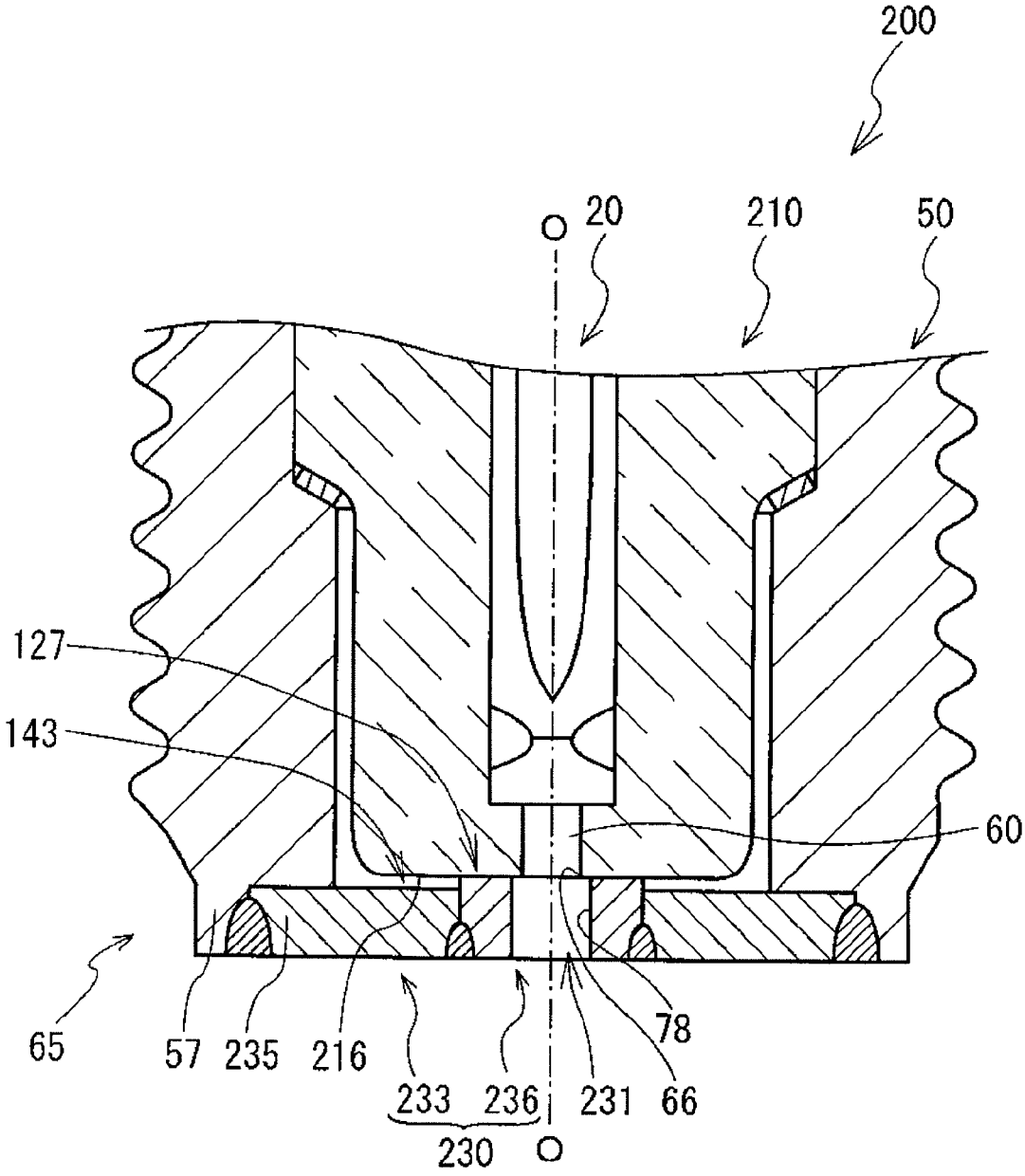
FIG. 11 is an enlarged sectional view of a front end portion of a plasma jet spark plug according to a second embodiment of the present invention.

Next, a plasma jet spark plug 200 according to a second embodiment of the present invention will be described with reference to the drawings. First, the structure of the plasma jet spark plug 200 will be described with reference to FIG. 11. FIG. 11 is a sectional view showing, on an enlarged scale, a front end portion of the plasma jet spark plug 200.

The plasma jet spark plug 200 of the second embodiment differs structurally from the plasma jet spark plug 100 of the first embodiment in that a ground electrode 230 assumes a different shape and that a front end portion 216 of an insulator 210 does not have a chip engagement portion. Thus, herein, the structure of a front end portion of the plasma jet spark plug 200 will described, and description of other structural features similar to those of the first embodiment will be omitted or abbreviated.

As shown in FIG. 11, similarly to the first embodiment, the ground electrode 230 disposed in the front end portion 65 of the metallic shell 50 is a composite member formed by joining together an electrode base metal 233 and a noble-metal chip or insert 236. The ground electrode 230 assumes a disk-like form and has a communication hole (communication section 231) formed at the radial center thereof. The noble-metal chip 236 assumes a cylindrical form. The electrode base metal 233 assumes a disk-like form and has a hole at the radial center thereof, the hole partially constituting the communication section 231. The noble-metal chip 236 and the electrode base metal 233 are laser-welded together at the interface therebetween in a state in which the outer circumferential surface of the noble-metal chip 236 faces the circumferential wall surface of the hole of the electrode base metal 233. The noble-metal chip 236, together with the hole of the electrode base metal 233, constitutes the communication section 231 of the ground electrode 230. The communication section 231 establishes communication between the cavity 60 and an ambient atmosphere via a communication hole surrounded by an inner circumferential wall 78 of the communication section 231.

An outer peripheral portion 235 of the ground electrode 230 (i.e., an outer peripheral portion 235 of the electrode base metal 233) is engaged with the stepped engagement portion 57 formed in the front end portion 65 of the metallic shell 50. In the thus-engaged condition, the interface therebetween undergoes laser welding, whereby the ground electrode 230 and the metallic shell 50 are joined together. A contact portion 127 provided on the rear end of the noble-metal chip 236 is in contact with the front end portion 216 of the insulator 210. As viewed in the direction of the axis O, the opening 66 of the cavity 60 is located internally of the contact portion 127. The noble-metal chip 236, which has the contact portion 127 and a portion of the communication section 231, closes a clearance between the front end portion 216 of the insulator 210 and the ground electrode 230. A noncontact portion 143 of the electrode base metal 233 is provided at the rear side of the electrode base metal 233 and faces the front end portion 216 of the insulator 210 without contacting the front end portion 216. Similar to the first embodiment, at the time of outward emission of plasma generated within the cavity 60, this configuration prevents leakage of energy of plasma into the clearance between the ground electrode 230 and the front end portion 216 of the insulator 210 and into a clearance between the metallic shell 50 and the insulator 210 which communicates with the former clearance. The noble-metal chip 236 corresponds to the "contact member" and the "noble-metal member" in the present invention.

Figure 12:
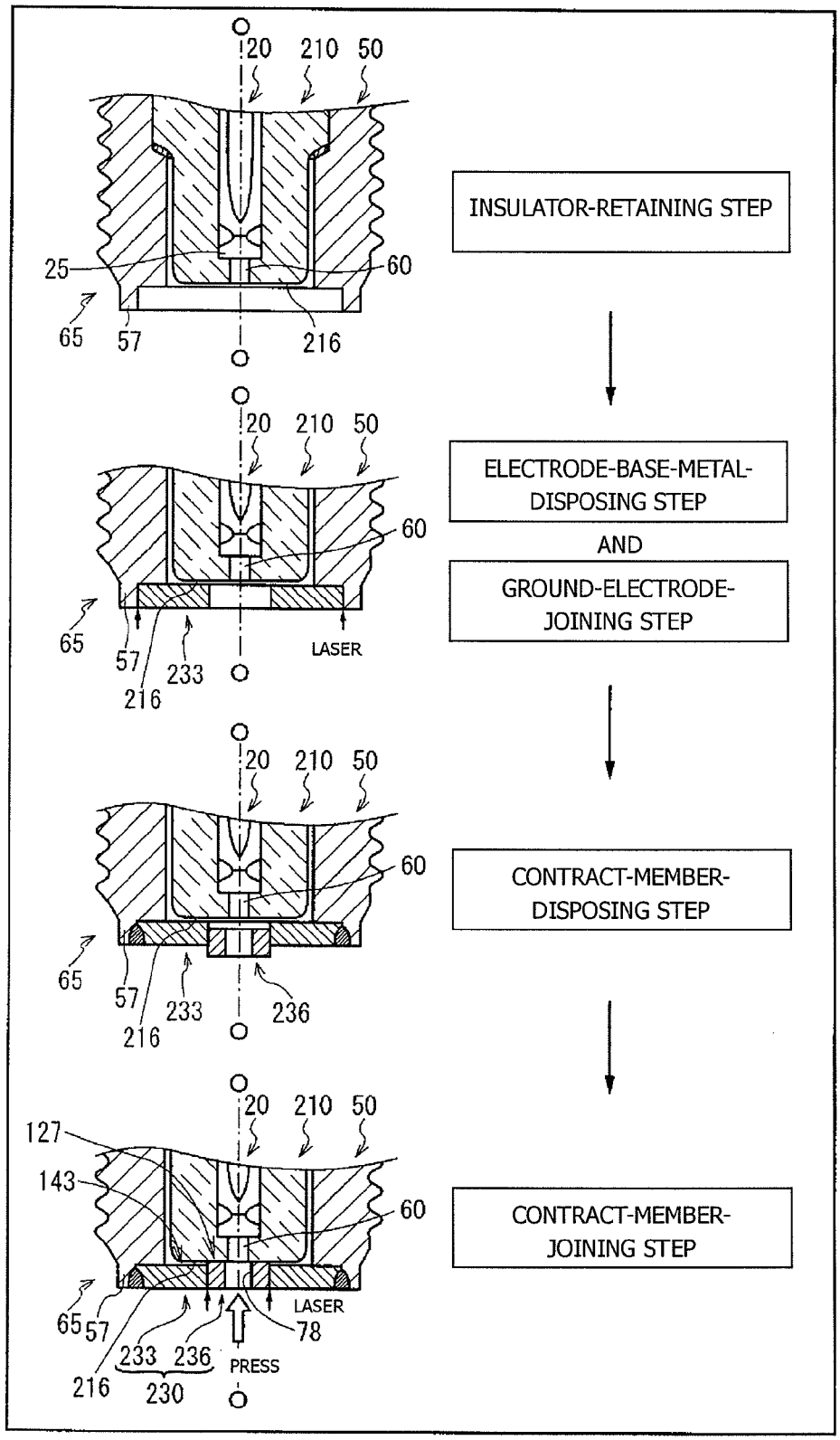
FIG. 12 is a diagram showing a portion of a manufacturing process for the plasma jet spark plug of the second embodiment.

Next, a manufacturing method for the plasma jet spark plug 200 of the second embodiment will be described with reference to FIG. 12. FIG. 12 partially shows a manufacturing process for the plasma jet spark plug 200.

As shown in FIG. 12, even in the manufacturing process for the plasma jet spark plug 200 of the second embodiment, the insulator 210, which has been prepared in a separate step in such a condition that the center electrode 20 and the metal terminal 40 (see FIG. 1) are attached thereto, is unitarily or uniformly retained by crimping the metallic shell 50, which has been prepared in a separate step (insulator-retaining step).

Next, the disk-like electrode base metal 233 having a hole is disposed frontward of the front end portion 216 of the insulator 210 (electrode-base-metal-disposing step). In this step, the outer peripheral portion 235 of the electrode base metal 233 is fitted to and engaged with the stepped engagement portion 57 of the metallic shell 50. At this time, the electrode base metal 233 is maintained in a state in which it is not in contact with the front end portion 216 of the insulator 210. In this condition, the interface between the outer peripheral portion 235 of the electrode base metal 233 and the stepped engagement portion 57 of the metallic shell 50 is irradiated with a laser beam along the entire circumference of the interface, thereby welding together the metallic shell 50 and the electrode base metal 233 of the ground electrode 230 (ground-electrode-joining step).

Then, the tubular noble-metal chip 236 is inserted into the hole of the electrode base metal 233 and disposed in the communication section 231 (contact-member-disposing step). The noble-metal chip 236 is in an unfixed condition. In the next step, the noble-metal chip 236 is pressed rearward, thereby closing a clearance between the noble-metal chip 236 and the front end portion 216 of the insulator 210, a clearance between the electrode base metal 233 of the ground electrode 230 and the front end portion 216 of the insulator 210, and a clearance between the metallic shell 50 and the insulator 210 which communicates with the clearance between the electrode base metal 233 and the front end portion 216 of the insulator 210. While the noble-metal chip 236 remains in a pressed condition, the interface between the noble-metal chip 236 and the electrode base metal 233 is irradiated with a laser beam along the entire circumference of the interface, whereby the noble-metal chip 236 and the electrode base metal 233 are welded together (contact-member-joining step). The noble-metal chip 236 and the electrode base metal 233 unitarily or uniformly form the communication section 231. By the above-described procedure, the ground electrode 230 is joined to the front end portion 65 of the metallic shell 50, thereby completing the plasma jet spark plug 200 of the second embodiment.

Even in the second embodiment, after the insulator 210 is retained in the metallic shell 50 by crimping, the ground electrode 230 is joined to the metallic shell 50; therefore, in the manufacturing process, breakage of the insulator 210 is unlikely to occur. Furthermore, a clearance which may be formed between the electrode base metal 233 of the ground electrode 230 and the front end portion 216 of the insulator 210 and a clearance which may be formed between the metallic shell 50 and the insulator 210 and communicates with the former clearance can be closed by the noble-metal chip 236, which has the contact portion 127 and partially constitutes the communication section 231, whereby impairment in ignition performance can be prevented.

Figure 13:
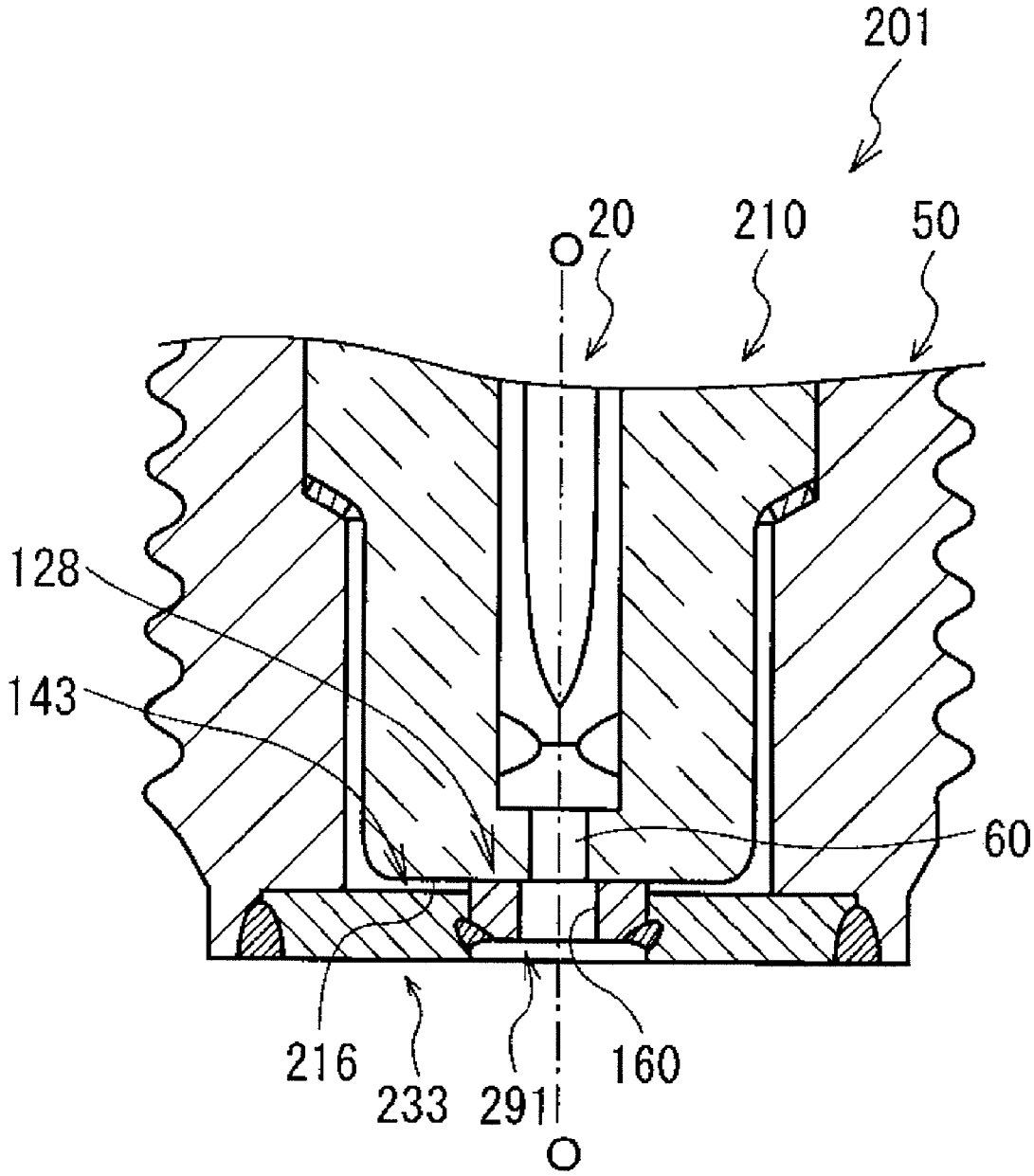
FIG. 13 is an enlarged sectional view of a front end portion of a plasma jet spark plug according to a modification of the second embodiment.
Figure 14:
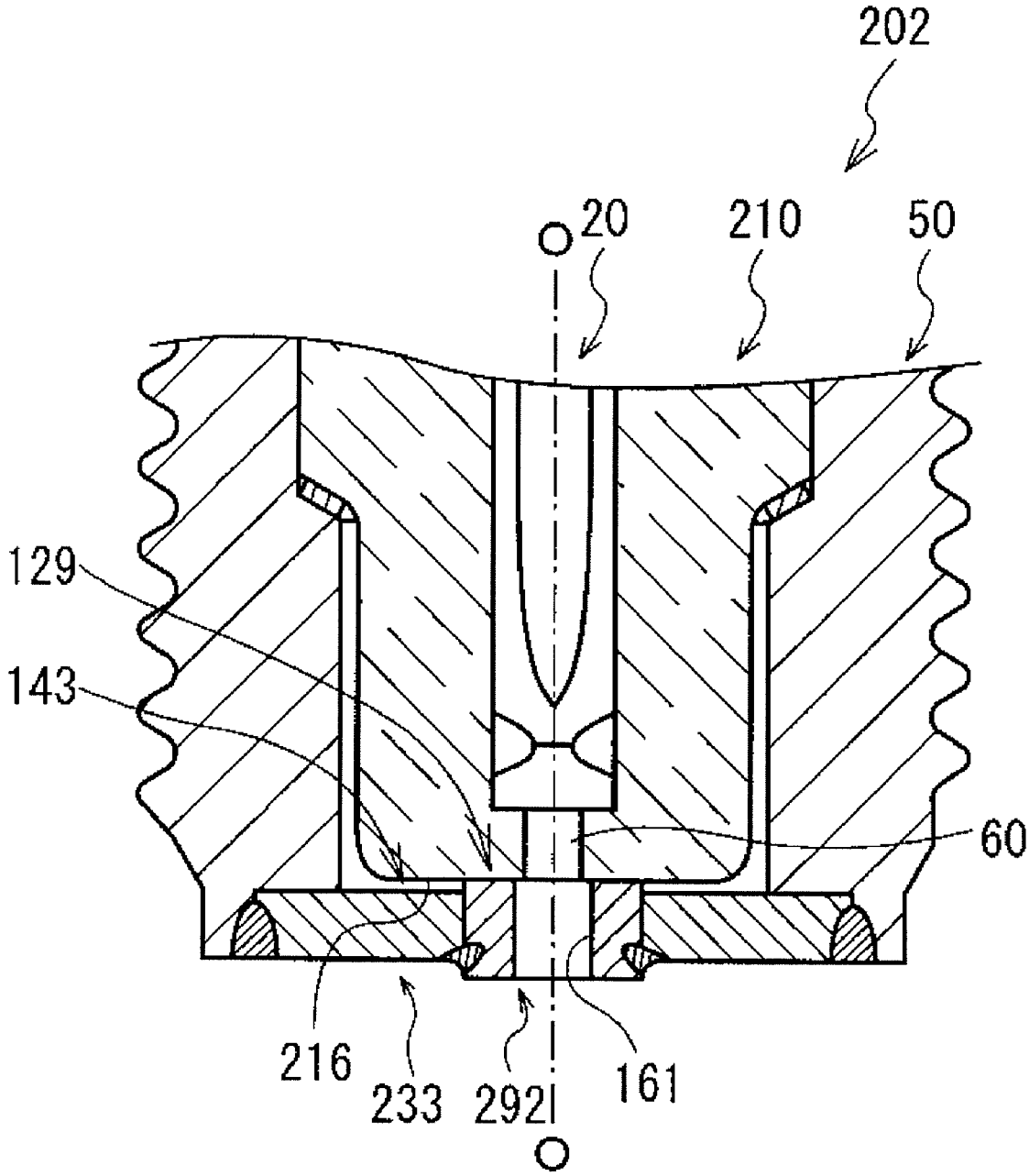
FIG. 14 is an enlarged sectional view of a front end portion of a plasma jet spark plug according to another modification of the second embodiment.

The plasma jet spark plug 200 of the second embodiment can also be modified in various other forms. For example, similarly to the first embodiment, as in the case of a plasma jet spark plug 201 and a plasma jet spark plug 202 shown in FIGS. 13 and 14, respectively, the length of a noble-metal chip 291, 292 along the direction of the axis O may be lengthened or shortened so as to impart a stepped geometry to an interfacial region between the noble-metal chip 291, 292 and the electrode base metal 233. In the process of laser-welding the noble-metal chip 291, 292 and the electrode base metal 33 in a state in which the contact portion 128, 129 of the noble-metal chip 291, 292 is in contact with the front end portion 216 of the insulator 210, the stepped geometry prevents penetration of a laser beam into a clearance between the mating surfaces of the noble-metal chip 291, 292 and the electrode base metal 233, thereby establishing a more reliably joined condition.

Figure 15:
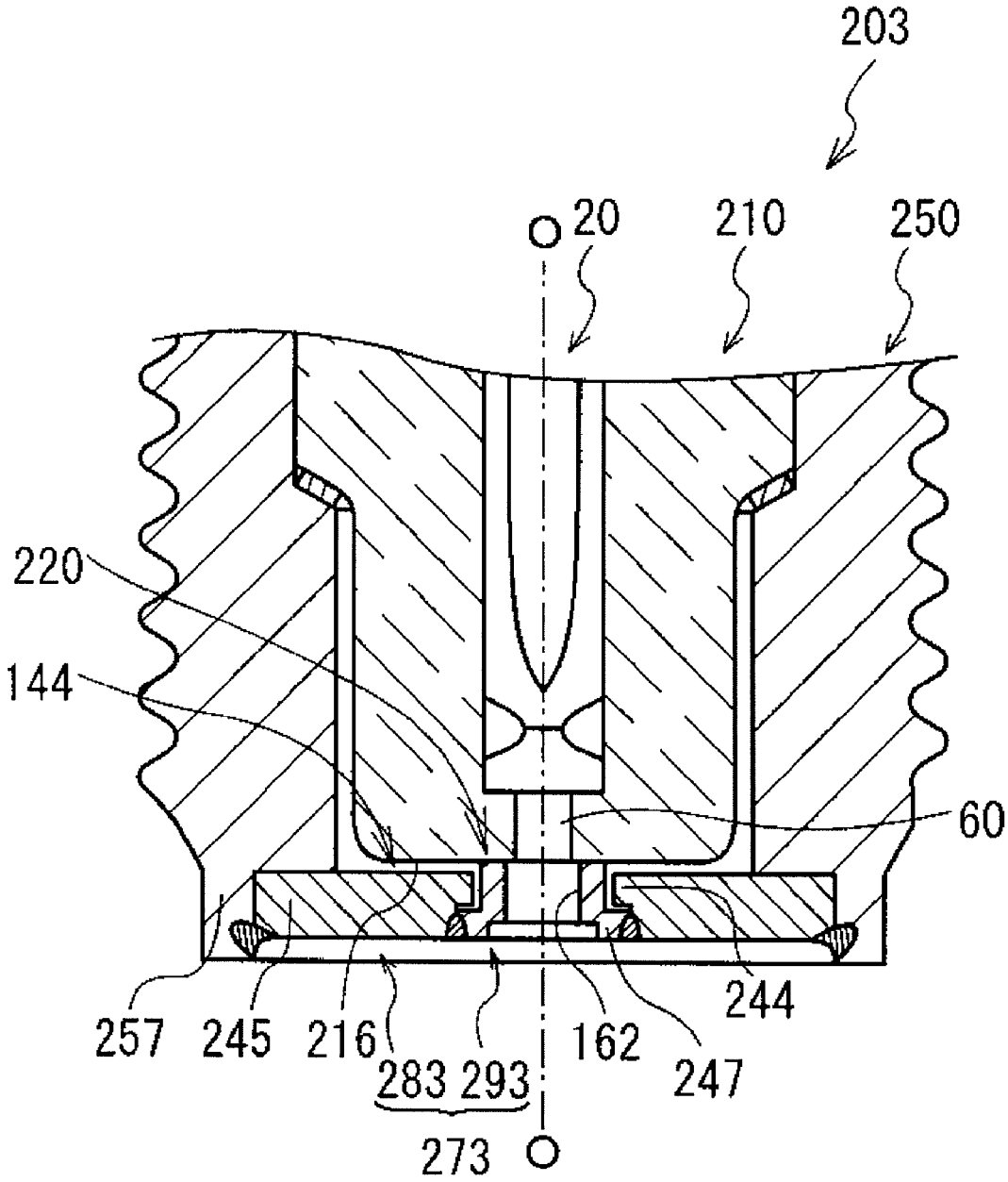
FIG. 15 is an enlarged sectional view of a front end portion of a plasma jet spark plug according to still another modification of the second embodiment.

Also, as in the case of a plasma jet spark plug 203 shown in FIG. 15, a tubular noble-metal chip 293 may have a flange-like outwardly projecting portion 247, which projects radially outward from an outer circumferential surface of a front end portion of the noble-metal chip 293. Furthermore, an electrode base metal 283 may have a stepped chip attachment portion 244, which is formed on the wall of a hole of the electrode base metal 283 in such a stepped form that a hole diameter on the front side is greater. By virtue of these configurational features, similarly to the first embodiment, a clearance between the electrode base metal 283 and the front end portion 216 of the insulator 210 can be closed by adjusting the position along the direction of the axis O where the noble-metal chip 293 is disposed, and the chip attachment portion 244 can prevent off-axis disposition of the noble-metal chip 293. Since use of the noble-metal chip 293 having such the outwardly projecting portion 247 imposes limitation on adjustment of the position along the direction of the axis O where the noble-metal chip 293 is disposed (when the outwardly projecting portion 247 abuts the chip attachment portion 244, the outwardly projecting portion 247 cannot move further rearward), it is better practice to additionally use the electrode base metal 283 for adjustment of the position where the noble-metal chip 293 is disposed. It is also good practice to provide the stepped engagement portion 257 of the metallic shell 250 in such a manner as to project frontward from the position of a ground electrode 273 engaged with the stepped engagement portion 257. In the process of joining together the stepped engagement portion 257 and an outer peripheral portion 245 of the electrode base metal 283, such the stepped engagement portion 257 facilitates application of a laser beam from an acute angle with respect to the axis O, thereby establishing a more reliably joined condition. Similarly to the modifications of the first embodiment, as in the case of the plasma jet spark plugs 202, 203 shown in FIGS. 14 and 15, the inner circumferential wall of the noble-metal chip 292 may serve as an inner circumferential wall 161, 162 of the communication section. Also, as in the case of the plasma jet spark plug 201 shown in FIG. 13, the inner circumferential wall of the noble-metal chip 291 may partially constitute an inner circumferential wall 160 of the communication section.

Figure 16:
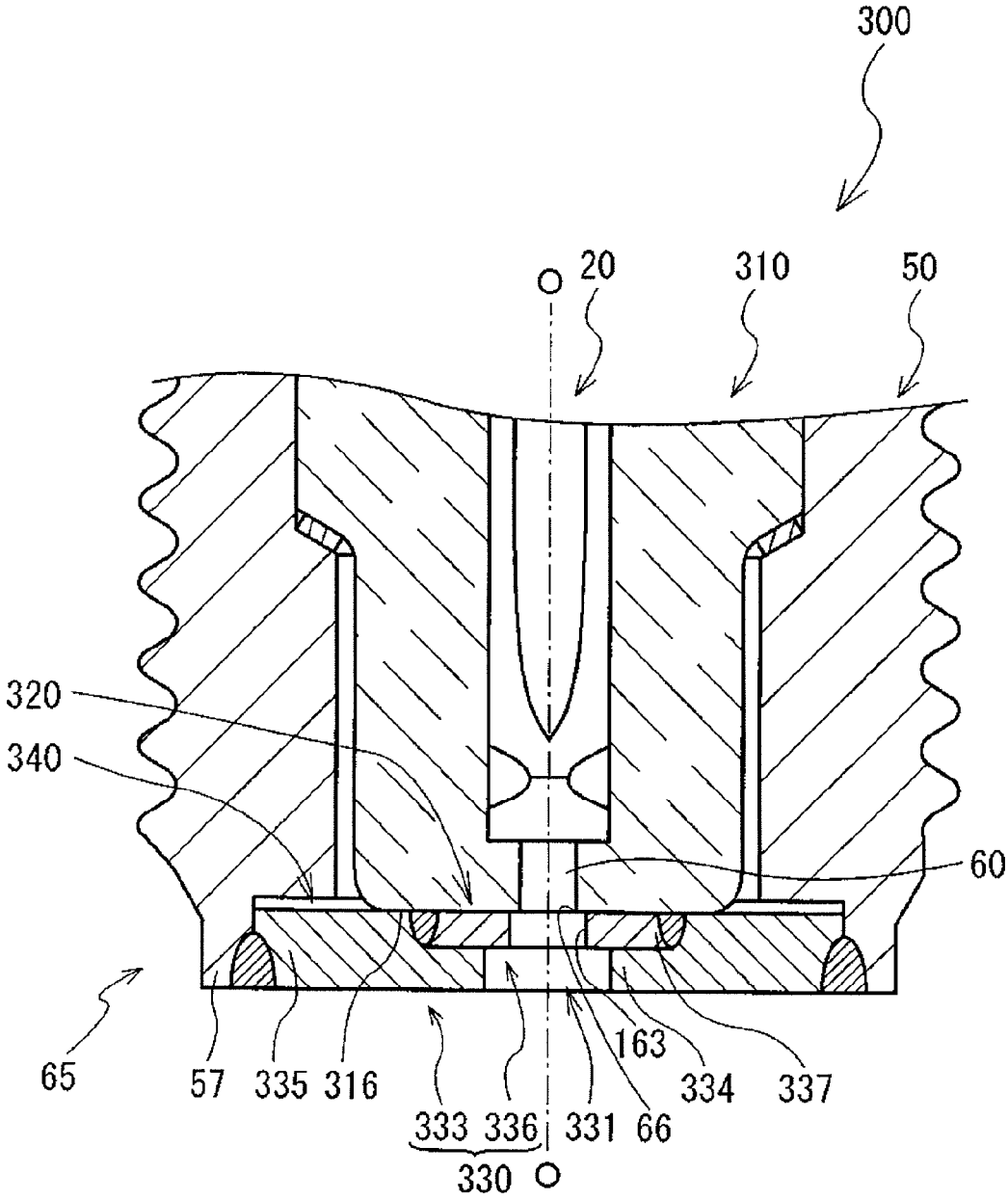
FIG. 16 is an enlarged sectional view of a front end portion of a plasma jet spark plug according to a third embodiment of the present invention.

Next, a plasma jet spark plug 300 according to a third embodiment of the present invention will be described with reference to the drawings. First, the structure of the plasma jet spark plug 300 will be described with reference to FIG. 16. FIG. 16 is a sectional view showing, on an enlarged scale, a front end portion of the plasma jet spark plug 300.

Similarly to the second embodiment, the plasma jet spark plug 300 of the third embodiment also differs structurally from the plasma jet spark plug 100 of the first embodiment in that a ground electrode 330 assumes a different shape and that a front end portion 316 of an insulator 310 does not have a chip engagement portion. Thus, herein, the structure of a front end portion of the plasma jet spark plug 300 will described, and description of other structural features similar to those of the first embodiment will be omitted or abbreviated.

As shown in FIG. 16, the ground electrode 330 disposed in the front end portion 65 of the metallic shell 50 is a composite member formed by joining together an electrode base metal 333 and a noble-metal chip or insert 336. The ground electrode 330 assumes a disk-like form and has a communication hole (communication section 331) formed at the radial center thereof. The noble-metal chip 336 and the electrode base metal 333 each assume a disk-like (annular) form and each have a hole at the radial center thereof. The noble-metal chip 336 is smaller in thickness than the electrode base metal 333. The electrode base metal 333 has a stepped chip attachment portion 334, which is formed on the wall of a hole of the electrode base metal 333 in such a stepped form that a hole diameter on the rear side is greater. The noble-metal chip 336 is disposed such that an outer peripheral portion 337 of the noble-metal chip 336 is engaged with the chip attachment portion 334 and such that a rear surface (a surface perpendicular to the thickness direction) of the noble-metal chip 336 flushes with a rear surface of the electrode base metal 333. The outer peripheral portion 337 of the noble-metal chip 336 is laser-welded to the electrode base metal 333. The noble-metal chip 336, together with the hole of the electrode base metal 333, constitutes the communication section 331 of the ground electrode 330.

An outer peripheral portion 335 of the ground electrode 330 (i.e., an outer peripheral portion 335 of the electrode base metal 333) is engaged with the stepped engagement portion 57 of the front end portion 65 of the metallic shell 50 such that a side of the ground electrode 330 to which the noble-metal chip 336 is joined faces the insulator 310. Furthermore, in a state in which the ground electrode 330 is in contact with the front end portion 316 of the insulator 310, the ground electrode 330 is laser-welded to the metallic shell 50, whereby the ground electrode 330 and the metallic shell 50 are joined together. By means of the ground electrode 330 and the front end portion 316 of the insulator 310 being in contact with each other, a clearance between the ground electrode 330 and the front end portion 316 of the insulator 310 and a clearance between the metallic shell 50 and the insulator 310, which communicates with the former clearance, are closed. A portion of the noble-metal chip 336 and a portion of the electrode base metal 333 which face and are in contact with the front end portion 316 of the insulator 310 collectively serve as a contact portion 320. The metallic shell 50 and a noncontact portion 340 of the electrode base metal 333 are not in contact with each other with respect to the direction of the axis O. Similarly to the first and second embodiments, at the time of outward emission of plasma generated within the cavity 60, this configuration prevents leakage of energy of plasma into the clearance between the ground electrode 330 and the front end portion 316 of the insulator 310. The noble-metal chip 336 corresponds to the "noble-metal member" in the present invention.

Figure 17:
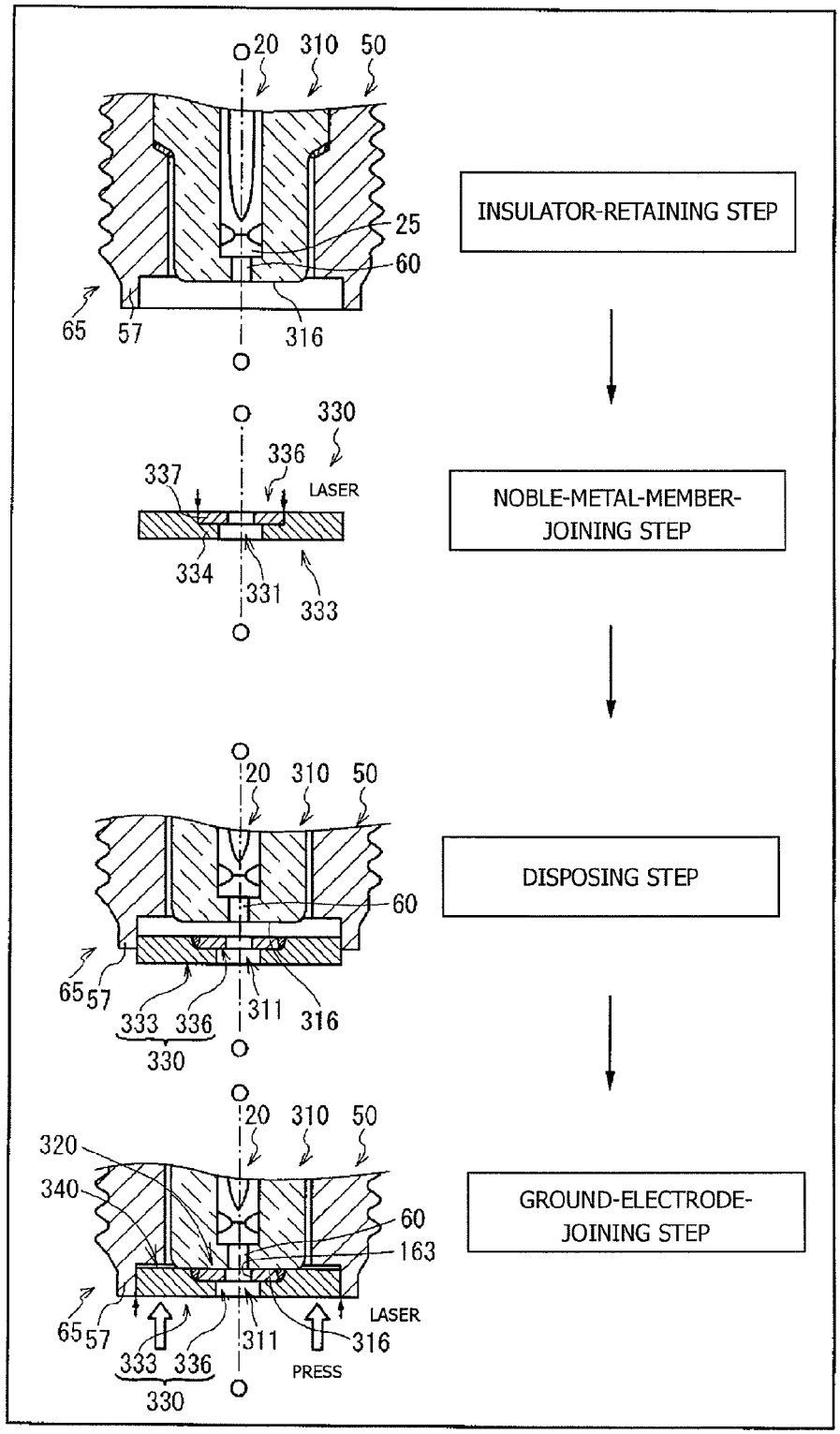
FIG. 17 is a diagram showing a portion of a manufacturing process for the plasma jet spark plug of the third embodiment.

Next, a manufacturing method for the plasma jet spark plug 300 of the third embodiment will be described with reference to FIG. 17. FIG. 17 partially shows a manufacturing process for the plasma jet spark plug 300.

As shown in FIG. 17, even in the manufacturing process for the plasma jet spark plug 300 of the third embodiment, the insulator 310, which has been prepared in a separate step in such a condition that the center electrode 20 and the metal terminal 40 (see FIG. 1) are attached thereto, is unitarily or uniformly retained by crimping in the metallic shell 50, which has been prepared in a separate step (insulator-retaining step).

Next, the outer peripheral portion 337 of the noble-metal chip 336 is engaged with the chip attachment portion 334 of the electrode base metal 333. At this time, the rear surface of the electrode base metal 333 and the rear surface of the noble-metal chip 336 are arranged to flush with each other. In this condition, the interface between the noble-metal chip 336 and the electrode base metal 333 is irradiated with a laser beam, whereby the noble-metal chip 336 and the electrode base metal 333 are joined together to form the ground electrode 330 (noble-metal-member-joining step). The noble-metal chip 336, together with the hole of the electrode base metal 333, constitutes the communication section 331.

Then, the thus-formed ground electrode 330 is disposed frontward of the front end portion 316 of the insulator 310 (disposing step). At this time, the ground electrode 330 is disposed in such a manner that a side of the ground electrode 330 where the noble-metal chip 336 is exposed (a side where the rear surface of the noble-metal chip 336 flushes with the rear surface of the electrode base metal 333) faces the front end portion 316 of the insulator 310 and that the direction of thickness of the ground electrode 330 coincides with the direction of the axis O. The ground electrode 330 is pressed rearward so as to bring the contact portion 320 into contact with the front end portion 316 of the insulator 310, thereby closing or even preventing formation of a clearance between the ground electrode 330 and the front end portion 316 of the insulator 310. In this condition, the interface between the outer peripheral portion 335 of the ground electrode 330 (i.e., the outer peripheral portion 335 of the electrode base metal 333) and the stepped engagement portion 57 of the metallic shell 50 is irradiated with a laser beam along the entire circumference of the interface, thereby welding together the metallic shell 50 and the ground electrode 330 (ground-electrode-joining step). By this procedure, the ground electrode 330 is joined to the front end portion 65 of the metallic shell 50, thereby completing the plasma jet spark plug 300 of the third embodiment.

Even in the third embodiment, after the insulator 310 is retained in the metallic shell 50 by crimping, the ground electrode 330 is joined to the metallic shell 50; therefore, in the manufacturing process, breakage of the insulator 310 is unlikely to occur. Since the step of joining the ground electrode 330 to the metallic shell 50 is carried out in a state in which the ground electrode 330 is pressed toward the insulator 310, no clearance can be formed between the ground electrode 330 and the front end portion 316 of the insulator 310. Thus, at the time of outward emission of plasma generated within the cavity 60, there can be avoided leakage of energy of plasma into the clearance between the ground electrode 330 and the front end portion 316 of the insulator 310, thereby preventing impairment in ignition performance.

Figure 18:
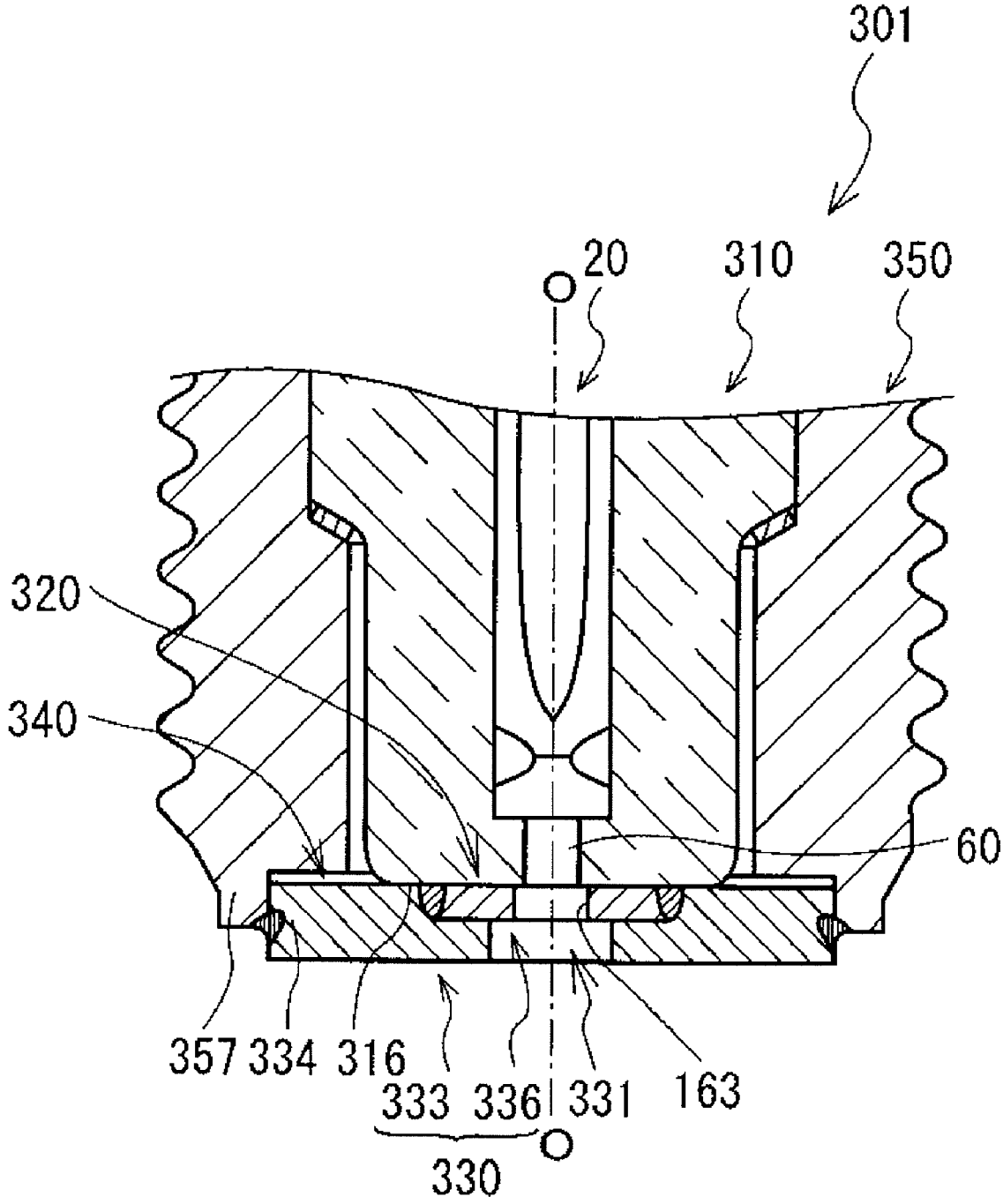
FIG. 18 is an enlarged sectional view of a front end portion of a plasma jet spark plug according to a modification of the third embodiment.

The plasma jet spark plug 300 of the third embodiment can also be modified in various other forms. For example, as in the case of a metallic shell 350 of a plasma jet spark plug 301 shown in FIG. 18, when the ground electrode 330 is engaged with a stepped engagement portion 357, the front end face of the stepped engagement portion 357 may be located rearward of the front-side surface of the ground electrode 330. Similarly to the aforementioned laser-welding process, in the process of joining together the stepped engagement portion 357 and the outer peripheral portion 335 of the ground electrode 330, such a configurational feature facilitates application of a laser beam from an acute angle with respect to the axis O, thereby establishing a more reliably joined condition. Also, although unillustrated, when the ground electrode 330 is engaged with the stepped engagement portion 357, the front end face of the stepped engagement portion 357 may be located frontward of the front-side surface of the ground electrode 330.

Figure 19:
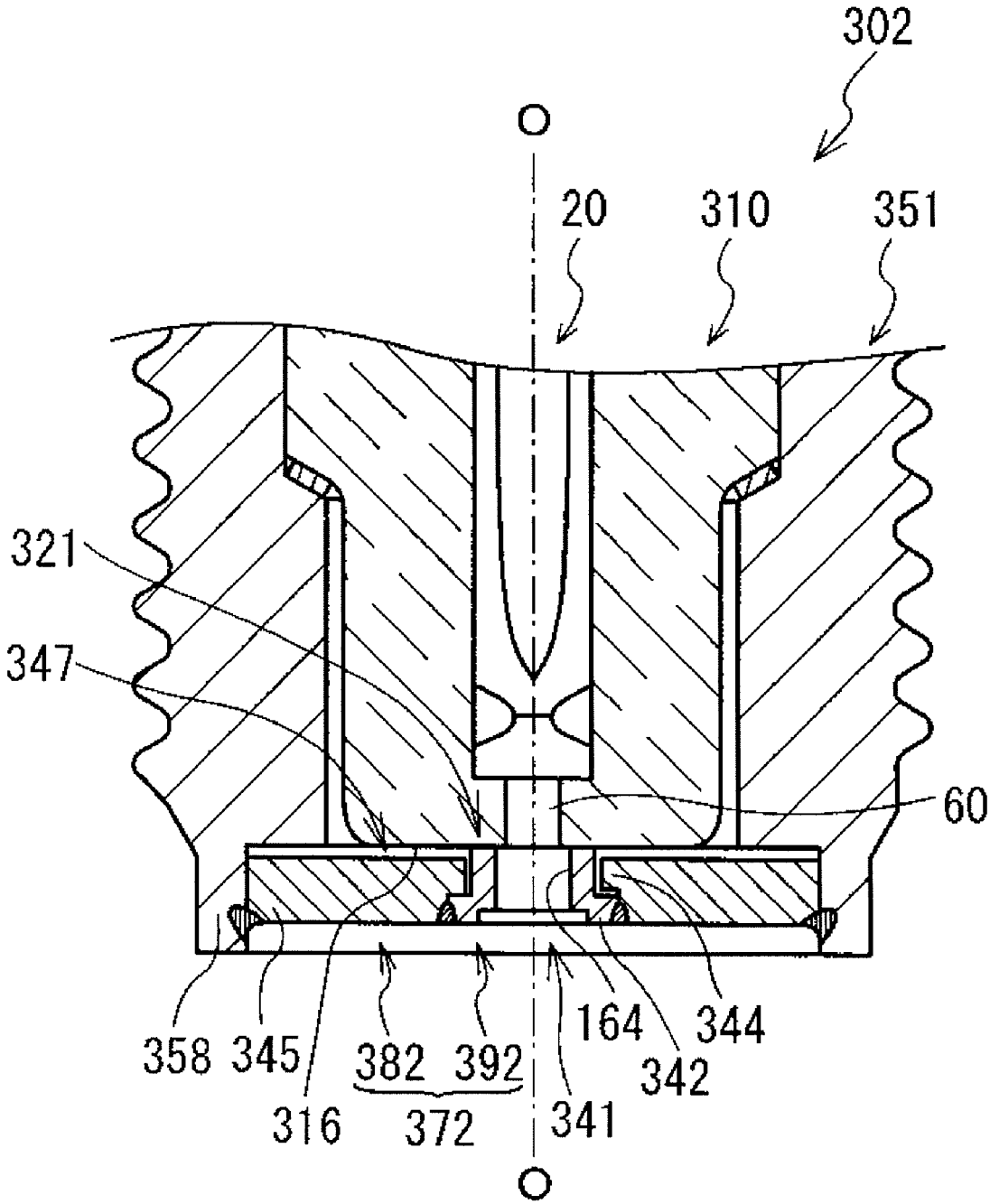
FIG. 19 is an enlarged sectional view of a front end portion of a plasma jet spark plug according to another modification of the third embodiment.
Figure 20:
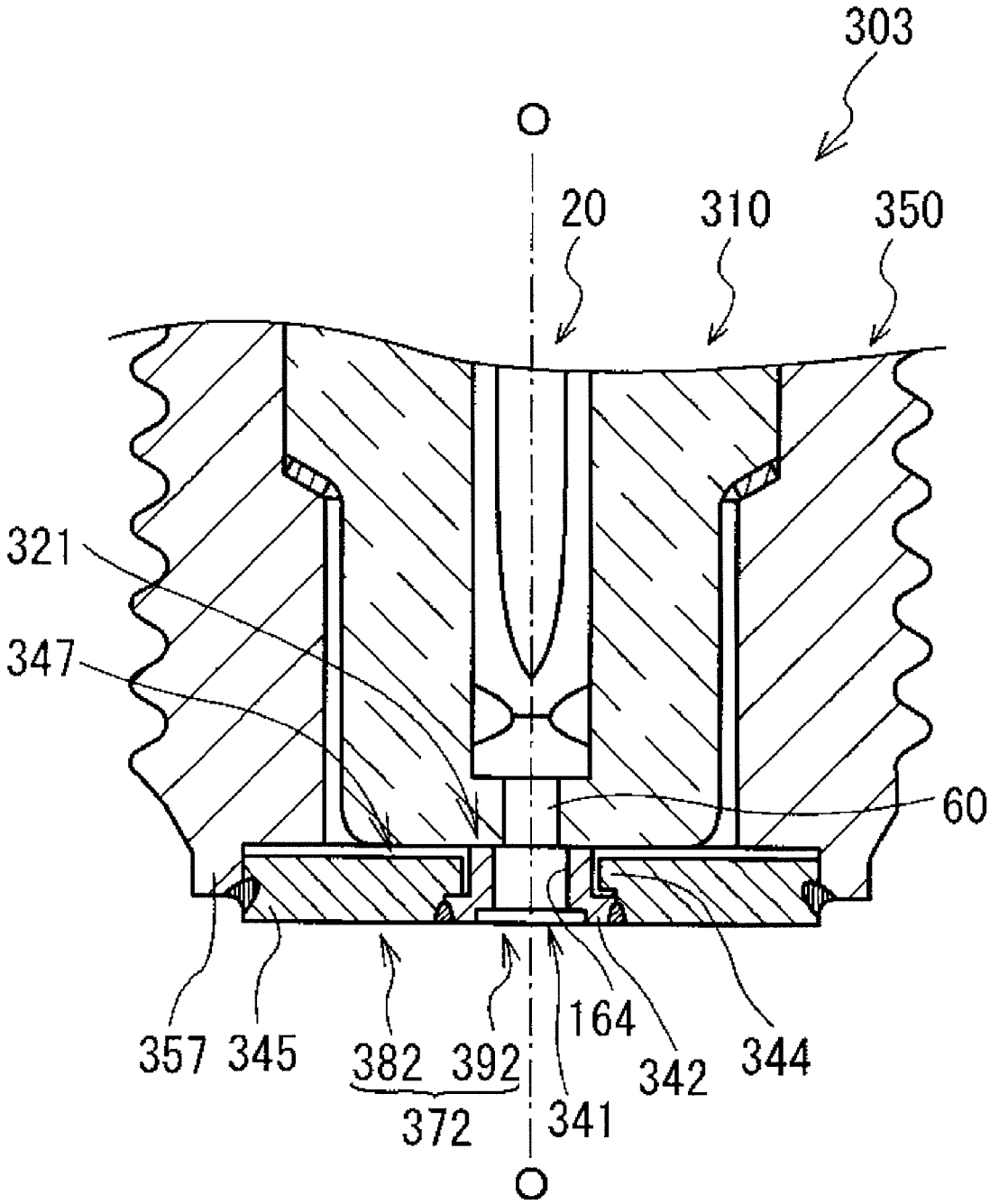
FIG. 20 is an enlarged sectional view of a front end portion of a plasma jet spark plug according to still another modification of the third embodiment.

Also, as shown in FIGS. 19 and 20 showing a plasma jet spark plug 302 and a plasma jet spark plug 303, respectively, a noble-metal chip 392, which partially constitutes a communication section 341 of a ground electrode 372, may assume a tubular form and may have a flange-like outwardly projecting portion 342, which projects radially outward from an outer circumferential surface of a front end portion of the noble-metal chip 392. Furthermore, an electrode base metal 382 has a stepped chip attachment portion 344, which is formed on the wall of a hole of the electrode base metal 382 such that a hole diameter on the front side is greater. That is, the electrode base metal 382 is configured to enable the noble-metal chip 392 to be positioned in relation to the electrode base metal 382. Such configurational features facilitate joining between the electrode base metal 382 and the noble-metal chip 392.

Also, it is good practice to configure the noble-metal chip 392 such that, when the noble-metal chip 392 is joined to the electrode base metal 382, a portion of the noble-metal chip 392 projects rearward from the rear surface of the electrode base metal 382, and to bring the projecting portion into contact with the front end portion 316 of the insulator 310 in the process of joining the ground electrode 372 to a metallic shell 351, 350. As compared with the case where the entire rear surface of the ground electrode 372 is brought into contact with the front end portion 316 of the insulator 310 to close a clearance between the ground electrode 372 and the front end portion 316 of the insulator 310, this practice can reduce the contact area therebetween, thereby facilitating management of smoothness of a contact surface (contact portion 321) adapted to close the clearance.

Furthermore, as in the case of the metallic shell 351 shown in FIG. 19 and the metallic shell 350 shown in FIG. 20, it is good practice to configure a stepped engagement portion 358, 357 such that, when the ground electrode 372 is engaged with the stepped engagement portion 358, 357, the front end face of the stepped engagement portion 358, 357 is located rearward or frontward of the front-side surface of the ground electrode 330. Similarly to the aforementioned laser-welding process, in the process of joining together the stepped engagement portion 358, 357 and an outer peripheral portion 345 of the ground electrode 372 in a state in which the contact portion 321 of the noble-metal chip 392 is in contact with the front end portion 316 of the insulator 310, such a configurational feature facilitates application of a laser beam from an acute angle with respect to the axis O, thereby establishing a more reliably joined condition. Similarly to the modifications of the first embodiment, as in the case of the plasma jet spark plugs 302, 303 shown in FIGS. 19 and 20, respectively, the inner circumferential wall of the noble-metal chip 392 may serve as an inner circumferential wall 164 of the communication section. Alternatively, as in the case of the plasma jet spark plug 301 shown in FIG. 18, the inner circumferential wall of the noble-metal chip 336 may partially constitute an inner circumferential wall 163 of the communication section. Furthermore, as in the case of the plasma jet spark plugs 302, 303 shown in FIGS. 19 and 20, respectively, only the noble-metal chip 392 may have the contact portion 321, and a noncontact portion 347 of the electrode base metal 382 may not be in contact with both of the metallic shell 351, 350 and the insulator 310. Alternatively, as in the case of the plasma jet spark plug 301 shown in FIG. 18, both of the noble-metal chip 336 and the electrode base metal 333 may have the contact portion 320, and the noncontact portion 340 of the electrode base metal 333 may not be in contact with the metallic shell 350 with respect to the direction of the axis O.

Figure 21:
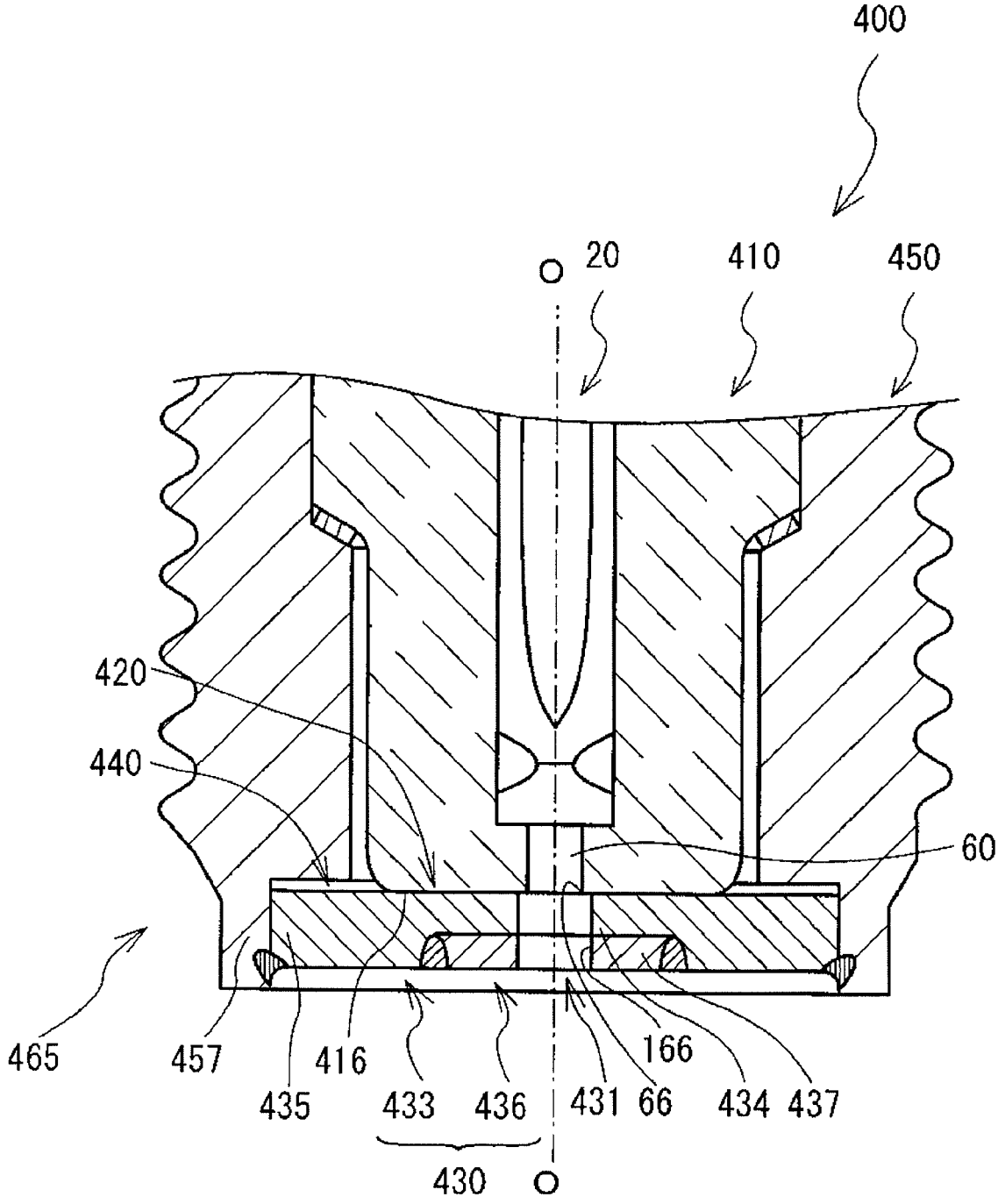
FIG. 21 is an enlarged sectional view of a front end portion of a plasma jet spark plug according to a fourth embodiment of the present invention.

Next, a plasma jet spark plug 400 according to a fourth embodiment of the present invention will be described with reference to the drawings. First, the structure of the plasma jet spark plug 400 will be described with reference to FIG. 21. FIG. 21 is a sectional view showing, on an enlarged scale, a front end portion of the plasma jet spark plug 400.

Similarly to the second and third embodiments, the plasma jet spark plug 400 of the fourth embodiment also differs structurally from the plasma jet spark plug 100 of the first embodiment in that a ground electrode 430 assumes a different shape and that a front end portion 416 of an insulator 410 does not have a chip engagement portion. Thus, herein, the structure of a front end portion of the plasma jet spark plug 400 will described, and description of other structural features similar to those of the first embodiment will be omitted or abbreviated.

As shown in FIG. 21, the ground electrode 430 disposed in a front end portion 465 of a metallic shell 450 is a composite member formed by joining together an electrode base metal 433 and a noble-metal chip 436. The ground electrode 430 assumes a disk-like form and has a communication hole (communication section 431) formed at the radial center thereof. The noble-metal chip 436 and the electrode base metal 433 each assume a disk-like (annular) form and each have a hole at the radial center thereof. The noble-metal chip 436 is smaller in thickness than the electrode base metal 433. The electrode base metal 433 has a stepped chip attachment portion 434, which is formed on the wall of a hole of the electrode base metal 433 in such a stepped form that a hole diameter on the front side is greater. The noble-metal chip 436 is disposed such that an outer peripheral portion 437 of the noble-metal chip 436 is engaged with the chip attachment portion 434 and such that a front surface of the noble-metal chip 436 flushes with a front surface of the electrode base metal 433. The outer peripheral portion 437 of the noble-metal chip 436 is laser-welded to the electrode base metal 433. The noble-metal chip 436, together with the hole of the electrode base metal 433, constitutes the communication section 431 of the ground electrode 430. In the plasma jet spark plug 400, a portion of the inner circumferential wall of the electrode base metal 433 and the inner circumferential wall of the noble-metal chip 436 constitute an inner circumferential wall 166 of the communication section 431.

An outer peripheral portion 435 of the ground electrode 430 (i.e., an outer peripheral portion 435 of the electrode base metal 433) is engaged with a stepped engagement portion 457 of the front end portion 465 of the metallic shell 450 such that a side of the ground electrode 430 to which the noble-metal chip 436 is joined faces frontward. Furthermore, in a state in which the ground electrode 430 is in contact with the front end portion 416 of the insulator 410, the ground electrode 430 is laser-welded to the metallic shell 450. By means of the ground electrode 430 and the front end portion 416 of the insulator 410 being in contact with each other, a clearance between the ground electrode 430 and the front end portion 416 of the insulator 410 is closed. A portion of the electrode base metal 433 which is in contact with the front end portion 416 of the insulator 410 serves as a contact portion 420. The electrode base metal 433 also has a noncontact portion 440 on its side which faces the metallic shell 450. The noncontact portion 440 is not in contact with the metallic shell 450 with respect to the direction of the axis O. Similarly to the third embodiment, at the time of outward emission of plasma generated within the cavity 60, this configuration prevents leakage of energy of plasma into the clearance between the ground electrode 430 and the front end portion 416 of the insulator 410. The noble-metal chip 436 corresponds to the "noble-metal member" in the present invention.

Figure 22:
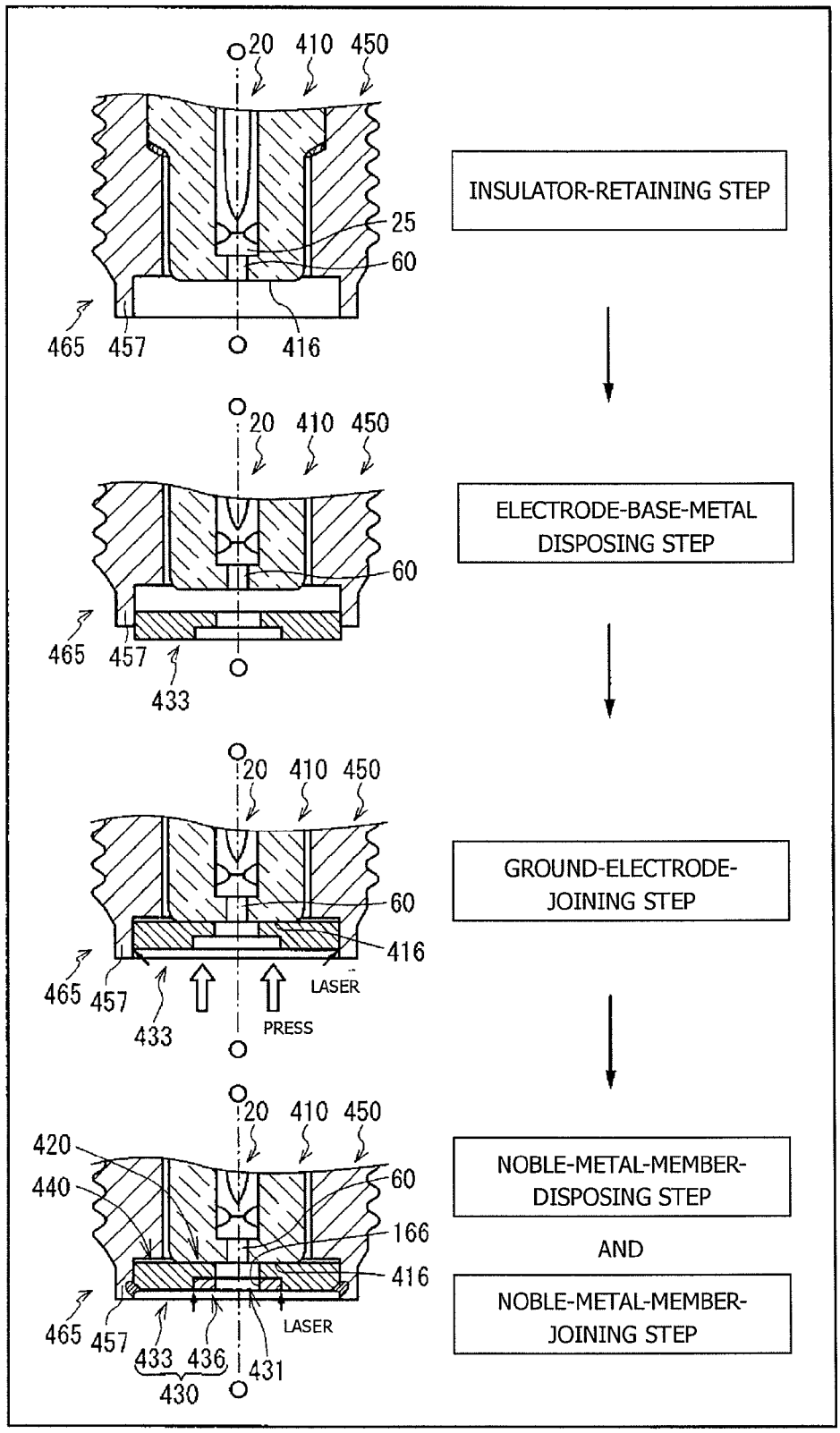
FIG. 22 is a diagram showing a portion of a manufacturing process for the plasma jet spark plug of the fourth embodiment.

Next, a manufacturing method for the plasma jet spark plug 400 of the fourth embodiment will be described with reference to FIG. 22. FIG. 22 partially shows a manufacturing process for the plasma jet spark plug 400.

As shown in FIG. 22, even in the manufacturing process for the plasma jet spark plug 400 of the fourth embodiment, the insulator 410, which has been prepared in a separate step in such a condition that the center electrode 20 and the metal terminal 40 (see FIG. 1) are attached thereto, is unitarily or uniformly retained by crimping in the metallic shell 450, which has been prepared in a separate step (insulator-retaining step).

Next, the disk-like electrode base metal 433 having a hole is disposed frontward of the front end portion 416 of the insulator 410 (electrode-base-metal-disposing step). In this step, the outer peripheral portion 435 of the electrode base metal 433 is fitted to and engaged with the stepped engagement portion 457 of the metallic shell 450. Furthermore, the electrode base metal 433 is pressed toward the front end portion 416 of the insulator 410, thereby closing a clearance between the electrode base metal 433 and the front end portion 416 of the insulator 410. In this condition, the interface between the outer peripheral portion 435 of the electrode base metal 433 and the stepped engagement portion 457 of the metallic shell 450 is irradiated with a laser beam along the entire circumference of the interface. In order to facilitate adjustment of the position where the electrode base metal 433 is disposed, the stepped engagement portion 457 is formed such that, when the electrode base metal 433 is disposed in the stepped engagement portion 457, the stepped engagement portion 457 projects frontward beyond the disposed electrode base metal 433. Thus, a laser beam can be applied from an acute angle with respect to the axis O. This joins the metallic shell 450 and the electrode base metal 433 of the ground electrode 430 more reliably (ground-electrode-joining step).

Then, the tubular noble-metal chip or insert 436 is inserted into the hole of the electrode base metal 433 and disposed in the communication section 431 (noble-metal-member-disposing step). In this condition, the interface between the noble-metal chip 436 and the electrode base metal 433 is irradiated with a laser beam along the entire circumference of the interface, whereby the noble-metal chip 436 and the electrode base metal 433 are welded together (noble-metal-member-joining step). The noble-metal chip 436 and the electrode base metal 433 unitarily or commonly form the communication section 431. By the above-described procedure, the ground electrode 430 is joined to the front end portion 465 of the metallic shell 450, thereby completing the plasma jet spark plug 400 of the fourth embodiment.

Even in the fourth embodiment, after the insulator 410 is retained in the metallic shell 450 by crimping, the ground electrode 430 is joined to the metallic shell 450. Therefore, in the manufacturing process, breakage of the insulator 410 is unlikely to occur. Since the step of joining the ground electrode 430 to the metallic shell 450 is carried out in a state in which the ground electrode 430 is pressed toward the insulator 410, no clearance can be formed between the ground electrode 430 and the front end portion 416 of the insulator 410. Therefore, impairment in ignition performance can be prevented.

Figure 23:
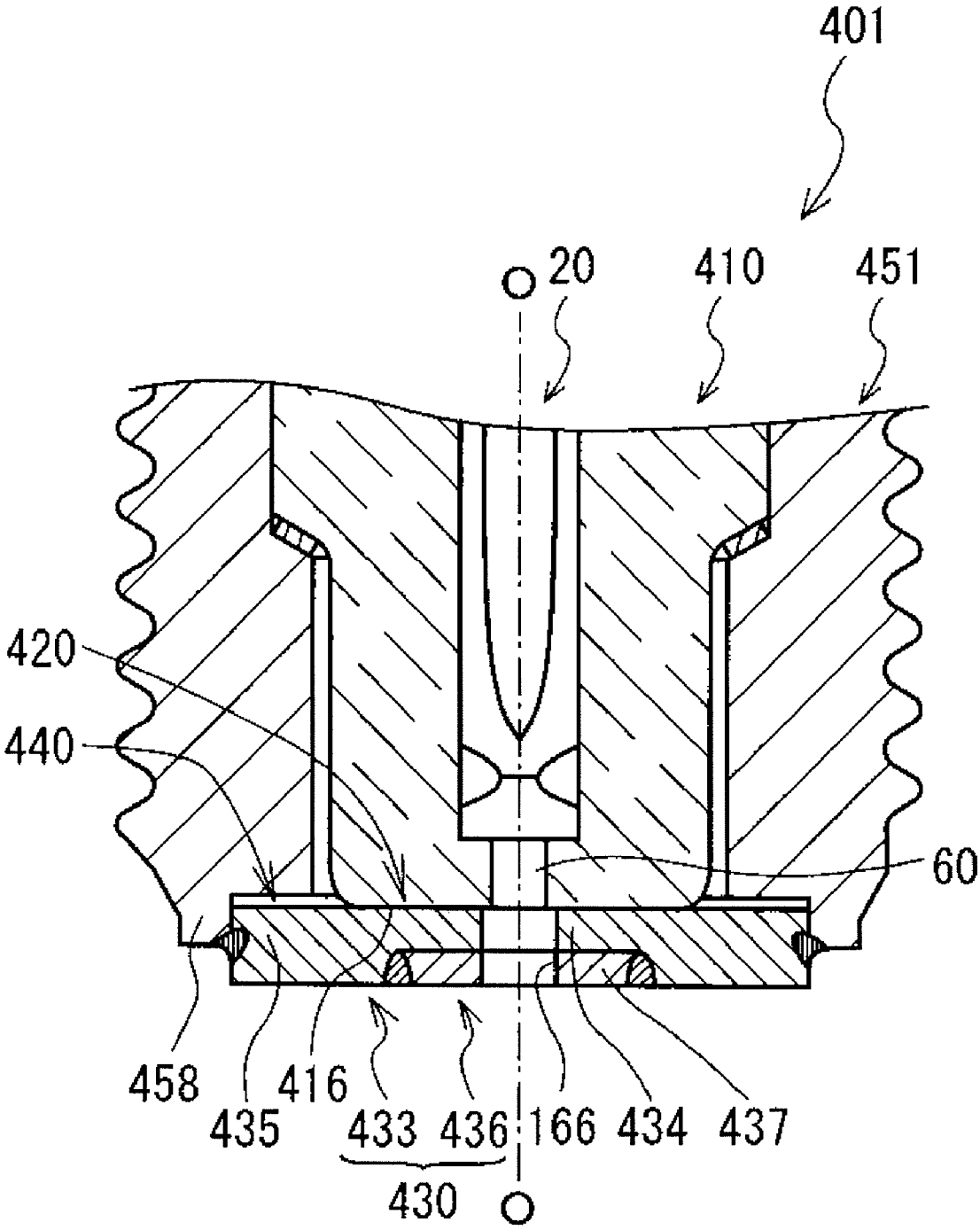
FIG. 23 is an enlarged sectional view of a front end portion of a plasma jet spark plug according to a modification of the fourth embodiment.

The plasma jet spark plug 400 of the fourth embodiment can also be modified in various other forms. For example, as in the case of a metallic shell 451 of a plasma jet spark plug 401 shown in FIG. 23, when the ground electrode 430 is engaged with a stepped engagement portion 458, the front end face of the stepped engagement portion 458 may be located rearward of the front-side surface of the ground electrode 430. Similarly to the aforementioned laser-welding process, in the process of joining together the stepped engagement portion 458 and the outer peripheral portion 435 of the ground electrode 430, such a configurational feature facilitates application of a laser beam from an acute angle with respect to the axis O, thereby establishing a more reliably joined condition.

Figure 24:
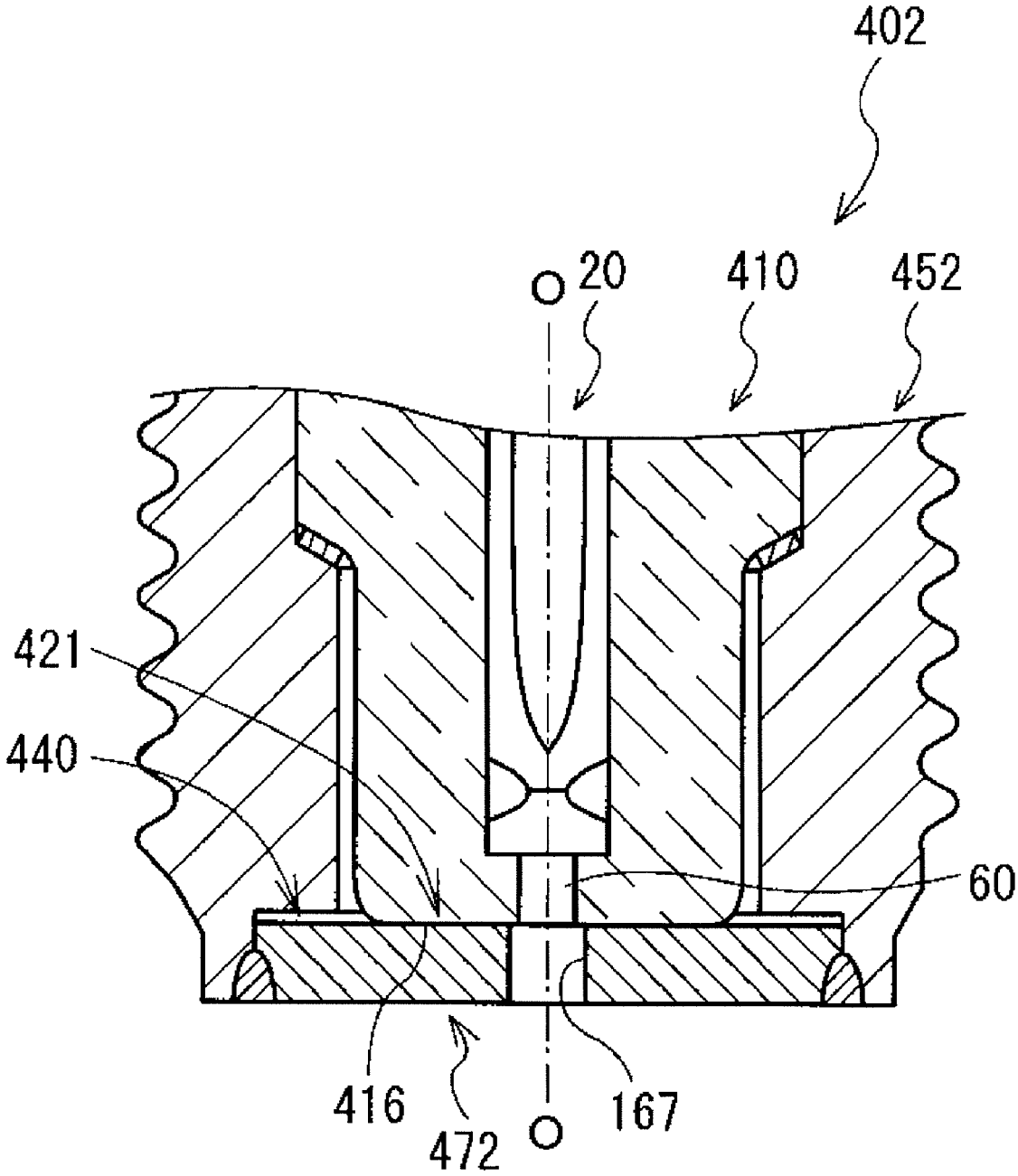
FIG. 24 is an enlarged sectional view of a front end portion of a plasma jet spark plug according to another modification of the fourth embodiment.
Figure 25:
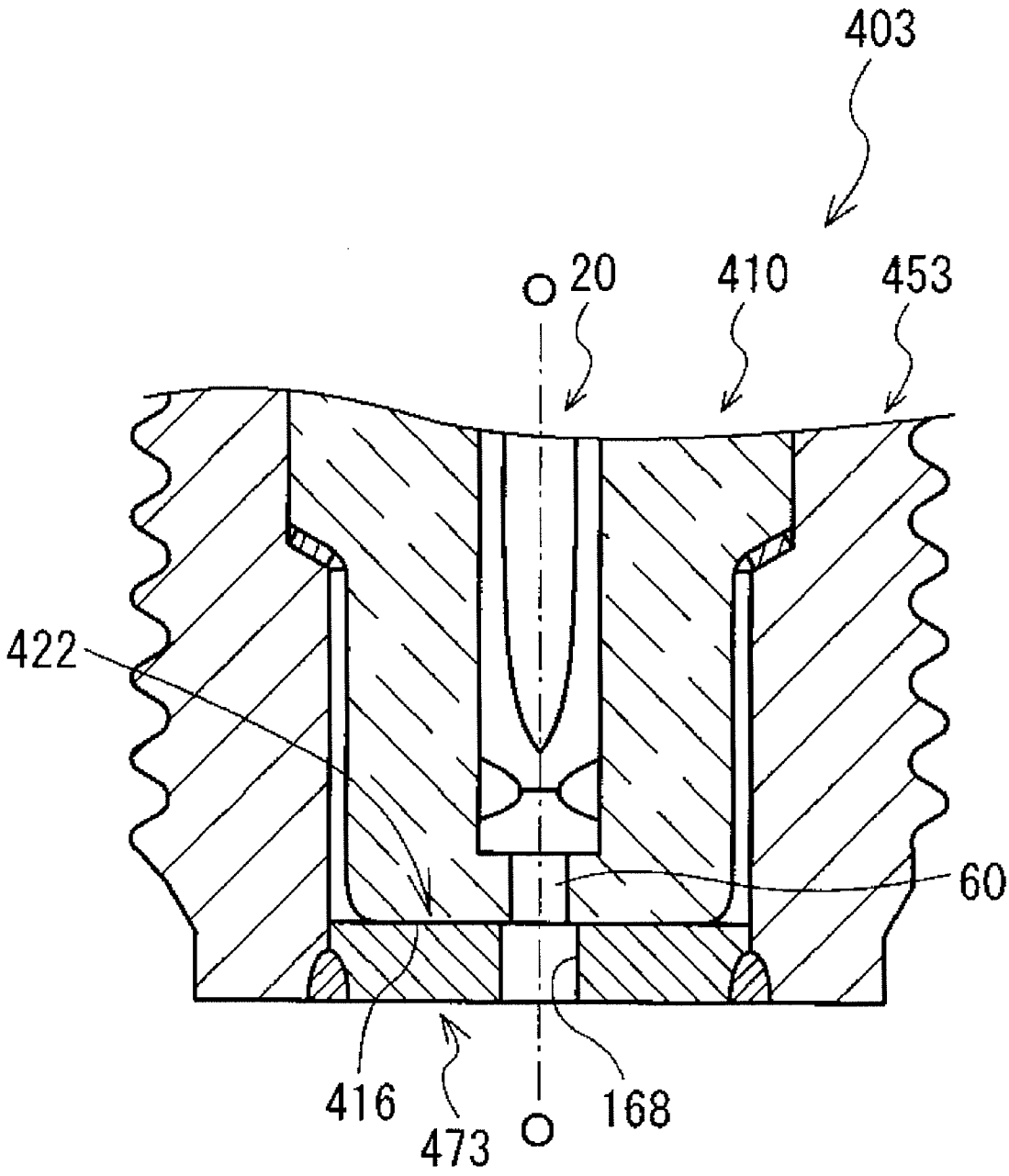
FIG. 25 is an enlarged sectional view of a front end portion of a plasma jet spark plug according to still another modification of the fourth embodiment.

Also, as in the case of a plasma jet spark plug 402 shown in FIG. 24, a ground electrode 472 may not have a noble-metal chip. Furthermore, in the plasma jet spark plugs of the third and fourth embodiments, the metallic shell has the stepped attachment portion. However, as in the case of a plasma jet spark plug 403 shown in FIG. 25, a metallic shell 453 may not have the stepped attachment portion. Even in the plasma jet spark plugs 402, 403, no clearance can be formed between the ground electrode 472, 473 and the front end portion 416 of the insulator 410 by means of carrying out the process of joining the ground electrode 472, 473 to the metallic shell 452, 453 in a state in which the ground electrode 472, 473 is pressed toward the front end portion 416 of the insulator 410 for causing a contact portion 421, 422 to be in contact with the front end portion 416. In the plasma jet spark plug 402, 403, the inner circumferential wall of the ground electrode 472, 473, which does not have a noble-metal chip, serves as an inner circumferential wall 167, 168 of the communication section.

The plasma jet spark plugs of the first to fourth embodiments are described while mentioning the tubular or annular noble-metal chips. In the plasma jet spark plugs of the third and fourth embodiments, the clearance between the ground electrode and the front end portion of the insulator is closed by use of the electrode base metal or the noble-metal chip joined to the electrode base metal. Therefore, it is not required that the noble-metal chip assumes a tubular or annular form. That is, in the third and fourth embodiments, if at least the electrode base metal assumes an annular form, and the electrode base metal is joined to the metallic shell while being in contact with the front end portion of the insulator, the clearance which may be formed between the electrode base metal and the front end portion of the insulator can be closed in a sufficiently satisfactory condition. Therefore, if the noble-metal chip is joined to the electrode base metal as a portion of the communication section such that spark discharge occurs between the noble-metal chip and the center electrode (i.e., dielectric breakdown resistance between the noble-metal chip and the center electrode is lower than that between the electrode base metal and the center electrode), the noble-metal chip suffices for use.

In the plasma jet spark plugs of the first to fourth embodiments, the contact portion is located toward the inner circumferential wall of the ground electrode. In the plasma jet spark plugs of the first and second embodiments, clearance is present between the ground electrode and the front end portion of the insulator, but the clearance does not communicate with the cavity, thereby restraining impairment in ignition performance to the greatest possible extent. However, the position of the contact portion with respect to a radial direction of the ground electrode is not limited to that of the above embodiments. For example, the contact portion may be located in a radially intermediate region of the ground electrode. That is, a clearance between the ground electrode and the front end portion of the insulator may communicate with the cavity. Even in this case, there can be closed a clearance between the ground electrode and the front end portion of the insulator which is located radially outward of the contact portion, and a clearance between the metallic shell and the insulator which communicates with the former clearance. However, in view of restraint of impairment in ignition performance, a small volume of the clearance between the ground electrode and the front end portion of the insulator, which communicates with the cavity, is preferred.

In the plasma jet spark plugs of the first and second embodiments, the clearance between the ground electrode and the insulator is closed by means of the noble-metal chip. Therefore, it is not required that the electrode base metal assumes an annular form, i.e., imparting a tubular or annular form to the noble-metal chip suffices for closure of the clearance. That is, the electrode base metal may be a member adapted to support the noble-metal chip in such a manner that the noble-metal chip is in contact with the front end portion of the insulator. Furthermore, the first to fourth embodiments use the noble-metal chip as a contact member; however, a metal chip of an electrically conductive material other than noble metal may be used as a contact member.

The plasma jet spark plugs of the first to fourth embodiments are described while mentioning so-called hot crimping for retaining the insulator in the metallic shell. However, no particular limitation is imposed on the retaining method. For example, crimping without use of heating; i.e., cold crimping, may be employed. Also, without use of talc, the insulator may be retained by means of an end portion of the crimp portion pressing the insulator directly or indirectly via packing or the like. Furthermore, the insulator may be retained by a method other than crimping. However, if an employed retaining method involves a step of pressing the insulator frontward, in view of prevention of breakage of the insulator, the pressing step is preferably carried out in a state in which no object abuts the front end portion of the insulator as in the case of the manufacturing process according to the present invention.

The written description above uses specific embodiments to disclose the invention, including the best mode, and also to enable any person skilled in the art to make and use the invention. While the invention has been described in terms of various specific embodiments, those skilled in the art will recognize that the invention can be practiced with modifications within the spirit and scope of the claims. Especially, mutually non-exclusive features of the embodiments described above may be combined with each other. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Having described the invention, the following is claimed:

1. A plasma jet spark plug comprising:

a center electrode;

an insulator having an axial bore extending in an axial direction, and retaining the center electrode within the axial bore in such a manner as to accommodate a front end face of the center electrode within a front end portion of the axial bore;

a cavity formed in a front end portion of the insulator, said cavity defined by a wall surface of the axial bore and a front end face of the center electrode;

a metallic shell surrounding and retaining the insulator from outside with respect to a radial direction perpendicular to the axial direction; and a ground electrode disposed frontward of the front end portion of the insulator with respect to the axial direction, said ground electrode having a contact portion contacting the front end portion of the insulator in an annular contact zone such that, as viewed from the axial direction, the cavity is located internally of the contact portion, said ground electrode further having a communication section for establishing communication between the cavity and an ambient atmosphere;

wherein the ground electrode is not in contact with the metallic shell with respect to the axial direction and is in contact with the metallic shell with respect to a radial direction perpendicular to the axial direction and is electrically connected with the metallic shell by means of an outer peripheral portion thereof being joined to the metallic shell.

2. A plasma jet spark plug according to claim 1, wherein the ground electrode is a composite member formed by joining an electrode base metal and a contact member together.

3. A plasma jet spark plug according to claim 2, wherein the electrode base metal of the ground electrode has an inwardly projecting portion located most inward with respect to the radial direction, and the contact member of the ground electrode has an outwardly projecting portion whose outer periphery is located radially outward of an inner periphery of the inwardly projecting portion of the base metal, and the outwardly projecting portion of the contact member is disposed rearward of the inwardly projecting portion of the base metal with respect to the axial direction.

4. A plasma jet spark plug according to claim 2, wherein the electrode base metal of the ground electrode has an inwardly projecting portion located most inward with respect to the radial direction, and the contact member of the ground electrode has an outwardly projecting portion whose outer periphery is located radially outward of an inner periphery of the inwardly projecting portion of the base metal, and the outer peripheral portion of the ground electrode is joined to the metallic shell such that the outwardly projecting portion of the contact member is disposed frontward of the inwardly projecting portion of the base metal with respect to the axial direction.

5. A plasma jet spark plug according to claim 1, wherein at least a portion of an inner peripheral wall of the communication section of the ground electrode is formed of a noble-metal member made of a noble metal.

6. A plasma jet spark plug according to any one of claims 1 to 5, wherein the front end portion of the insulator has an engagement portion with which the contact portion is engaged.

* * * * *